US008235513B2

(12) United States Patent
Shinada et al.

(10) Patent No.: US 8,235,513 B2
(45) Date of Patent: Aug. 7, 2012

(54) LIQUID INJECTING METHOD AND LIQUID CONTAINER

(75) Inventors: Satoshi Shinada, Shiojiri (JP); Chiaki Miyajima, Matsumoto (JP); Masahide Matsuyama, Nagano-ken (JP); Yuichi Seki, Matsumoto (JP); Hisashi Koike, Suwa (JP); Taku Ishizawa, Matsumoto (JP); Takayoshi Katsumura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1243 days.

(21) Appl. No.: 11/837,782

(22) Filed: Aug. 13, 2007

(65) Prior Publication Data

US 2008/0036833 A1 Feb. 14, 2008

(30) Foreign Application Priority Data

Aug. 11, 2006 (JP) ..... P2006-220755
Aug. 12, 2006 (JP) ..... P2006-220762
Jul. 18, 2007 (JP) ..... P2007-186992

(51) Int. Cl.
*B41J 2/175* (2006.01)

(52) U.S. Cl. ..... 347/86

(58) Field of Classification Search ..... 347/7, 19, 347/49, 84, 85, 86
See application file for complete search history.

(56) References Cited

U.S. PATENT DOCUMENTS 5,721,576 A * 2/1998 Barinaga ..... 347/85
5,790,157 A * 8/1998 Higuma et al. ..... 347/85
5,790,158 A 8/1998 Shinada et al.
5,854,835 A * 12/1998 Montgomery et al. .. 379/112.06

(Continued)

FOREIGN PATENT DOCUMENTS

EP 1164021 A2 12/2001

(Continued)

OTHER PUBLICATIONS

European Search Report issued on Jun. 30, 2011 in the corresponding European Patent Application No. 11162208.0.

(Continued)

*Primary Examiner* — Anh T. N. Vo
(74) *Attorney, Agent, or Firm* — Sughrue Mion, PLLC

(57) ABSTRACT

A method of injecting a liquid into a liquid container detachably mounted on a liquid consuming device, the liquid container including: a liquid containing chamber in which the liquid can be contained; a liquid supply hole connectable to the liquid consuming device; a liquid guide passage for guiding the liquid contained in the liquid containing chamber to the liquid supply hole; an air communicating passage communicating the liquid containing chamber with an air; and a liquid residual quantity sensor provided in the liquid guide passage and for outputting different signals between in a case where the liquid guide passage is filled with the liquid and in a case where the liquid guide passage includes air entered thereinto, wherein the liquid containing chamber including at least three liquid containing chambers, and wherein the liquid containing chambers are mutually connected so as to have a descending connection where a pair of the liquid containing chambers are mutually connected so that a liquid flow in the liquid guide passage is a descending flow from above to below and an ascending connection where a pair of the liquid containing chambers are mutually connected so that the liquid flow in the liquid guide passage is an ascending flow from below to above, the method includes: forming an injection port, which communicates with the liquid containing chamber, in the air communicating passage; injecting a predetermined amount of liquid through the injection port; and sealing the injection port after injecting the liquid.

12 Claims, 11 Drawing Sheets

U.S. PATENT DOCUMENTS

| | | | | |
|---|---|---|---|---|
| 6,036,305 | A | 3/2000 | Nagasaki et al. | |
| 6,848,776 | B2 * | 2/2005 | Nishioka et al. | 347/86 |
| 7,090,341 | B1 * | 8/2006 | Miyazawa | 347/85 |
| 7,125,108 | B2 * | 10/2006 | Toba et al. | 347/86 |
| 7,165,835 | B2 * | 1/2007 | Ota et al. | 347/86 |
| 7,513,613 | B2 * | 4/2009 | Ishizawa et al. | 347/86 |
| 7,543,925 | B2 * | 6/2009 | Ishizawa et al. | 347/85 |
| 7,635,180 | B2 * | 12/2009 | Hattori et al. | 347/86 |
| 2002/0109760 | A1 | 8/2002 | Miyazawa et al. | |
| 2007/0222833 | A1 | 9/2007 | Ishizawa et al. | |
| 2008/0012914 | A1 | 1/2008 | Ishizawa et al. | |
| 2008/0012915 | A1 | 1/2008 | Ishizawa et al. | |
| 2008/0036808 | A1 | 2/2008 | Shinada et al. | |

FOREIGN PATENT DOCUMENTS

| | | | |
|---|---|---|---|
| EP | 1258359 | A1 | 11/2002 |
| EP | 1258362 | A1 | 11/2002 |
| EP | 1314565 | A3 | 11/2003 |
| EP | 1380429 | A2 | 1/2004 |
| EP | 1661710 | A2 | 5/2006 |
| EP | 1661710 | A3 | 11/2006 |
| EP | 1757453 | A1 | 2/2007 |
| EP | 1792734 | A2 | 6/2007 |
| GB | 2424211 | A | 9/2006 |
| JP | 08-132635 | A | 5/1996 |
| JP | 2001-146019 | A | 5/2001 |
| JP | 2001-146030 | A | 5/2001 |
| JP | 2004-167692 | A | 6/2004 |
| JP | 2004-203059 | A | 7/2004 |
| JP | 4407678 | B2 | 11/2009 |
| WO | 2007/122793 | A1 | 11/2007 |
| WO | 2007/122794 | A1 | 11/2007 |

OTHER PUBLICATIONS

Office Action issued Jun. 7, 2011 in counterpart Vietnamese Application No. 1-2009-00274

Extended European Search Report issued for Application No. 07792420.7; dated Sep. 30, 2010.

* cited by examiner

LIQUID INJECTING METHOD AND LIQUID CONTAINER

BACKGROUND

1. Technical Field

The present invention relates to a method of injecting a liquid into a liquid container that is attached to and detached from a liquid consuming device and that supplies the liquid contained in the liquid containing chamber to the liquid consuming device, and the liquid container manufactured by filling it with the liquid re-filling.

2. Related Art

Examples of the liquid container and the liquid consuming device include an ink cartridge storing an ink liquid and an ink jet printing apparatus to which the displaceable ink cartridge is mounted.

The ink cartridge that can be attached to and detached from a cartridge mount portion of the ink jet printing apparatus normally includes an ink containing chamber for filling with ink (liquid), an ink supply hole for supplying the liquid stored in the ink containing chamber to the ink jet printing apparatus, an ink guide passage for allowing the ink containing chamber to communicate with the ink supply hole, and an air communicating passage for introducing air into the ink containing chamber from the outside with a consumption of the ink stored in the ink containing chamber. When the ink cartridge is mounted on the cartridge mount portion of a printing apparatus, an ink supply needle equipped in the cartridge mount portion is inserted though the ink supply hole to supply the stored ink to a print head of the ink jet printing apparatus.

The print head of the ink jet printing apparatus controls an ejecting operation of ink drops using heat or vibration. By the way, if the print head performs the ejecting operation of the ink in a state where the ink of the ink cartridge is exhausted and not supplied, an idle printing occurs and thus the print head is damaged. In order to prevent the idle printing from occurring in the ink jet printer, it is necessary to monitor an amount of the ink liquid remaining in the ink cartridge.

Accordingly, in order to prevent the idle printing from occurring when the ink stored in a carriage is completely exhausted, there is suggested an ink cartridge that is equipped with a liquid residual quantity sensor for generating a predetermined electrical signal when the amount of the ink remaining in the ink containing chamber is consumed to a threshold set in advance (for example, see Patent Document 1).

Patent Document 1: JP-A-2001-146030

An ink cartridge is a container that is constituted by various constituents with a high precision. For this reason, when ink is exhausted, a disposal of the ink cartridge results in a waste of useful resources and a considerable economic loss.

Accordingly, it is required that the used ink cartridge be recovered by re-filling the ink thereinto.

However, in the known ink cartridge, since the ink-filling step is performed in the course of manufacturing the ink cartridge, there are many cases where the same ink-filling step cannot be performed after finishing the manufacture of the ink cartridge.

Accordingly, it is necessary to develop a recovery method of realizing the ink re-filling, instead of the ink-filling method used when a new ink cartridge is manufactured.

A recent ink cartridge becomes high performance in that a differential pressure valve that is provided to an ink guide passage for allowing the ink containing chamber to communicate with an ink supple hole to adjust an ink pressure that allows the ink to be supplied to the ink supply hole and that also serves as a check valve for preventing the ink from flowing backward from an ink supply hole is provided, or a liquid residual quantity sensor that is used for detecting an amount of the residual ink are equipped in the ink cartridge. Moreover, a configuration of the ink containing chamber or an air communicating passage becomes complex to maintain a good quality of the stored ink for a long time.

For this reason, if the step of injecting the ink into the ink cartridge is carelessly arranged, the ink may leak into portions other than the ink containing chamber or an original function may be damaged due to bubbles mixed at the time of re-filling the ink. Therefore, a poor recovery may be caused.

In addition, if a recovery cost is more expensive than a manufacturing cost of a new ink cartridge due to a processing complexity or a considerable processing cost in injecting the ink into the ink cartridge, there is no sense in recovering the ink cartridge.

SUMMARY

An advantage of some aspects of the invention is to enable a liquid container to be manufactured at a low price since a process in the liquid container is small when a liquid is injected into the liquid container and the liquid can be injected without damaging an original function of the liquid container. The advantage can be attained by at least one of the following aspects:

A first aspect of the invention provides a method of injecting a liquid into a liquid container detachably mounted on a liquid consuming device, the liquid container comprising: a liquid containing chamber in which the liquid can be contained; a liquid supply hole connectable to the liquid consuming device; a liquid guide passage for guiding the liquid contained in the liquid containing chamber to the liquid supply hole; an air communicating passage communicating the liquid containing chamber with an air; and a liquid residual quantity sensor and provided in the liquid guide passage and for outputting different signals between in a case where the liquid guide passage is filled with the liquid and in a case where the liquid guide passage includes air entered thereinto, wherein the liquid containing chamber including at least three liquid containing chambers, and wherein the liquid containing chambers are mutually connected so as to have a descending connection where a pair of the liquid containing chambers are mutually connected so that a liquid flow in the liquid guide passage is a descending flow from above to below and an ascending connection where a pair of the liquid containing chambers are mutually connected so that the liquid flow in the liquid guide passage is an ascending flow from below to above, the method comprising: forming an injection port, which communicates with the liquid containing chamber, in the air communicating passage; injecting a predetermined amount of liquid through the injection port; and sealing the injection port after injecting the liquid.

According to such a configuration, the process performed to inject the liquid into the liquid container include the steps of opening the injection port for injecting the liquid, injecting the liquid, and sealing the injection port, which are all simple. Accordingly, a processing cost is low and it is not difficult to perform the steps.

When the injection port is provided in the air communicating passage, the liquid can be smoothly injected into all the plurality of liquid containing chambers and the liquid guide passage for allowing the liquid containing chambers to communicate with each other. Accordingly, in the liquid container into which the liquid is injected, a configuration of an upward and downward zigzag winding passage is recovered in the liquid guide passage in which the liquid containing chambers are mutually connected so as to form the descending connection and the ascending connection. Even when bubbles occur in the liquid containing chambers in an upstream side, the liquid existing in the descending liquid guide passage serves as a barrier wall that blocks the movement of the bubbles. For this reason, it is difficult for the bubbles entering into the liquid guide passage to flow to a downstream side.

In addition to the zigzag passages for allowing the liquid containing chambers to be mutually connected, the upper space of each liquid containing chamber in the downstream side effectively serves as a trapping space of the inflow bubbles, and thus blocks the downstream movement of the bubbles.

A second aspect of the invention provides a liquid container detachably mounted on a liquid consuming device, the liquid container comprising: a liquid containing chamber in which the liquid can be contained; a liquid supply hole connectable to the liquid consuming device; a liquid guide passage for guiding the liquid contained in the liquid containing chamber to the liquid supply hole; an air communicating passage communicating the liquid containing chamber with an air; and a liquid residual quantity sensor provided in the liquid guide passage and for outputting different signals between in a case where the liquid guide passage is filled with the liquid and in a case where the liquid guide passage includes air entered thereinto, wherein the liquid containing chamber including at least three liquid containing chambers, wherein the liquid containing chambers are mutually connected so as to have a descending connection where a pair of the liquid containing chambers are mutually connected so that a liquid flow in the liquid guide passage is a descending flow from above to below and an ascending connection where a pair of the liquid containing chambers are mutually connected so that the liquid flow in the liquid guide passage is an ascending flow from below to above; and wherein an injection port communicating with the liquid containing chamber is formed in the air communicating passage, a predetermined amount of liquid is injected through the injection port, and the injection port is sealed after injecting the liquid.

According to such a configuration, even when the bubbles flow into the liquid guide passage for allowing the liquid containing chambers to communicate with the liquid supply portion, it is difficult for the bubbles entering into the liquid guide passage to flow to the downstream side during the period when usable liquid remains in the liquid guide passage for allowing the liquid containing chambers to communicate with each other or in the liquid containing chambers. As a result, the liquid can be injected without damaging an original function of the liquid containing chambers due to the bubble inflow.

Since a recovery cost is low and the liquid container can be supplied at a low price, a running cost of the liquid consuming device can be reduced.

A third aspect of the invention provides method of injecting a liquid into a liquid container detachably mounted on a liquid consuming device, the liquid container comprising: a liquid containing chamber in which the liquid can be contained; a liquid supply hole connectable to the liquid consuming device; a liquid guide passage for guiding the liquid contained in the liquid containing chamber to the liquid supply hole; and an air communicating passage communicating the liquid containing chamber to an air, wherein the liquid containing chamber including at least three liquid containing chambers, and wherein the liquid containing chambers are mutually connected so as to have a descending connection where a pair of the liquid containing chambers are mutually connected so that a liquid flow in the liquid guide passage is a descending flow from above to below and an ascending connection where a pair of the liquid containing chambers are mutually connected so that the liquid flow in the liquid guide passage is an ascending flow from below to above, the method comprising: forming an injection port, which communicates with the liquid containing chamber, in the air communicating passage; injecting a predetermined amount of liquid through the injection port; and sealing the injection port after injecting the liquid.

According to such a configuration, the process performed to inject the liquid into the liquid container include the steps of opening the injection port for injecting the liquid, injecting the liquid, and sealing the injection port, which are all simple. Accordingly, the processing cost is low and it is not difficult to perform the steps.

When the injection port is provided in the air communicating passage, the liquid can be smoothly injected into all the plurality of liquid containing chambers and the liquid guide passage for allowing the liquid containing chambers to communicate with each other. Accordingly, in the liquid container into which the liquid is injected, a configuration of an upward and downward zigzag winding passage is recovered in the liquid guide passage in which the liquid containing chambers are mutually connected so as to form the descending connection and the ascending connection. Even when bubbles occur in the liquid containing chambers in the upstream side, the liquid existing in the descending liquid guide passage serves as a barrier wall that blocks the movement of the bubbles.

In addition to the winding passages for allowing the liquid containing chamber to be connected to each other, the upper space of each liquid containing chamber in the downstream side effectively serves as a trapping space of the inflow bubble, and thus blocks the downstream movement of the bubbles.

In the liquid injecting method in the above-described configuration, a plurality of combinations of the descending connection and the ascending connection may be provided.

According to the liquid injecting method in such a configuration, a configuration of an upward and downward zigzag winding passage is recovered in the liquid guide passage in which the liquid containing chambers are mutually connected so as to form plural combinations of the descending connection and the ascending connection. As a result, it is more difficult for the bubbles entering into the liquid guide passage to flow to the downstream side.

In the liquid injecting method in the above-described configuration, a liquid residual quantity sensor for outputting different signals between in a case where the liquid guide passage is filled with the liquid and in a case where the liquid guide passage includes air entered thereinto, and wherein the liquid residual quantity sensor may be provided on a more downstream side than the descending connection and the ascending connection in the liquid guide passage.

According to the liquid injecting method in such a configuration, even when the bubbles enter from the liquid containing chambers to the liquid guide passage with which the liquid residual sensor communicates, the bubbles entering to the liquid guide passage can be prevented from reaching the detection position of the liquid residual sensor owing to the zigzag-shaped liquid guide passage, which allows the liquid containing chambers to be mutually connected, or the liquid containing chambers. As a result, the problem that an amount of disposed liquid increases due to an erroneous detection of the liquid residual quantity sensor caused by the bubble inflow can be solved.

A fourth aspect of the invention provides a liquid container detachably mounted on a liquid consuming device, the liquid container comprising: a liquid containing chamber in which the liquid can be contained; a liquid supply hole connectable to the liquid consuming device; a liquid guide passage for guiding the liquid contained in the liquid containing chamber to the liquid supply hole; and an air communicating passage communicating the liquid containing chamber to an air, wherein the liquid containing chamber including at least three liquid containing chambers, and wherein the liquid containing chambers are mutually connected so as to have a descending connection where a pair of the liquid containing chambers are mutually connected so that a liquid flow in the liquid guide passage is a descending flow from above to below and an ascending connection where a pair of the liquid containing chambers are mutually connected so that the liquid flow in the liquid guide passage is an ascending flow from below to above; and wherein an injection port communicating with the liquid containing chamber is formed in the air communicating passage, a predetermined amount of liquid is injected through the injection port, and the injection port is sealed after injecting the liquid.

According to such a configuration, even when the bubbles flow into the liquid guide passage for allowing the liquid containing chambers to communicate with the liquid supply portion, it is difficult for the bubbles entering into the liquid guide passage to flow to the downstream side during the period when usable liquid remains in the liquid guide passage, which allows the liquid containing chambers to communicate with each other, or in the liquid containing chambers. As a result, the liquid can be injected without damaging the original function of the liquid containing chambers due to the bubble inflow.

Since the recovery cost is low and thus the liquid container can be supplied at a low price, the running cost of the liquid consuming device can be reduced.

In the liquid injecting method in the above-described configuration, a plurality of combinations of the descending connection and the ascending connection may be provided.

According to the liquid injecting method in such a configuration, a configuration of the upward and downward zigzag winding passage is recovered in the liquid guide passage in which the liquid containing chambers are mutually connected so as to form plural combinations of the descending connection and the ascending connection. As a result, it is more difficult for the bubbles entering into the liquid guide passage to flow to the downstream side.

In the liquid container with the above-described configuration, a liquid residual quantity sensor for outputting different signals between in a case where the liquid guide passage is filled with the liquid and in a case where the liquid guide passage includes air entered thereinto may be provided on a more downstream side than the descending connection and the ascending connection in the liquid guide passage.

According to the liquid container with such a configuration, when the amount of liquid stored in the liquid containing chambers is consumed to a threshold that is set in advance, a predetermined signal can be output. Even when the bubbles enter from the liquid containing chambers to the liquid guide passage with which the liquid residual quantity sensor communicates, the bubbles entering to the liquid guide passage can be prevented from reaching the detection position of the liquid residual quantity sensor owing to the zigzag-shaped liquid guide passage, which allows the liquid containing chambers to be mutually connected, or the liquid containing chambers. As a result, there can be solved the problem that an amount of disposed liquid increases due to an erroneous detection of the liquid residual quantity sensor caused by the bubble inflow.

In the liquid container with the above-described configuration, the air communicating passage may be provided with an air chamber for preventing the liquid from leaking from the liquid containing chamber.

According to the liquid container having such a configuration, even when the liquid leaks from the liquid containing chambers to atmosphere due to thermal expansion or the like, the air chamber reliably traps, thereby preventing the liquid from leaking. Since the liquid trapped in the air chamber is configured to flow into the liquid containing chambers with a consumption of the liquid, the liquid contained in the inside can be used without a waste.

In the liquid container with the above-described configuration, at least a part of the air communicating passage may pass through the uppermost portion in a gravity direction of the liquid container.

According to the liquid container with such a configuration, even when the liquid flows backward, it is difficult for the liquid to reach the air opening hole of the container body beyond the uppermost portion in the gravity direction. As a result, the liquid can be prevented form leaking.

In the liquid container with the above-described configuration, the air communicating passage may be provided with a gas-liquid separating filter for allowing a gas to pass therethrough and preventing a liquid from passing therethrough.

According to the liquid container with such a configuration, even when the liquid flows in the air communicating passage, the liquid does not leak into the air opening hole beyond the gas-liquid separating filter owing to the gas-liquid separating filter provided in the air communicating passage. As a result, the liquid can be further prevented from leaking through the air introducing hole.

In the liquid container with the above-described configuration, the liquid container may be packed in a depressurized pack sealed so that the inner pressure is below the air pressure.

According to the liquid container with such a configuration, since the inner pressure of the liquid container is maintained below a specified value by a negative pressure-sucking force of the depressurized pack before a use, it is possible to supply a liquid in which dissolved air is low.

A fifth aspect of the invention provides method of injecting a liquid into a liquid container detachably mounted on a liquid consuming device, the liquid container comprising: a liquid containing chamber in which the liquid can be contained; a liquid supply hole connectable to the liquid consuming device; a liquid guide passage for guiding the liquid contained in the liquid containing chamber to the liquid supply hole; and an air communicating passage communicating the liquid containing chamber to an air, wherein the liquid containing chamber including at least three liquid containing chambers, and wherein the liquid containing chambers are mutually connected so as to have a descending connection where a pair of the liquid containing chambers are mutually connected so that a liquid flow in the liquid guide passage is a descending flow from above to below and an ascending connection where a pair of the liquid containing chambers are mutually connected so that the liquid flow in the liquid guide passage is an ascending flow from below to above, the method comprising: forming an injection port on the liquid containing chamber positioned on the most upstream side; injecting a predetermined amount of liquid through the injection port; and sealing the injection port after injecting the liquid.

According to such a configuration, the process performed to inject the liquid into the liquid container include the steps of opening the injection port for injecting the liquid, injecting the liquid, and sealing the injection port, which are all simple. Accordingly, the processing cost is low and it is not difficult to perform the steps.

When the injection port is provided on the liquid containing chamber positioned on the most upstream side, the liquid can be smoothly injected into all the plurality of liquid containing chambers and the liquid guide passage for allowing the liquid containing chambers to communicate with each other. Accordingly, in the liquid container into which the liquid is injected, a configuration of an upward and downward zigzag winding passage is recovered in the liquid guide passage in which the liquid containing chambers are mutually connected so as to form the descending connection and the ascending connection. Even when bubbles occur in the liquid containing chambers in the upstream side, the liquid existing in the descending liquid guide passage serves as a barrier wall that blocks the movement of the bubbles.

In addition to the winding passages for allowing the liquid containing chamber to be connected to each other, the upper space of each liquid containing chamber in the downstream side effectively serves as a trapping space of the inflow bubble, and thus blocks the downstream movement of the bubbles.

In the liquid injecting method in the above-described configuration, a plurality of combinations of the descending connection and the ascending connection may be provided.

According to the liquid injecting method in such a configuration, a configuration of an upward and downward zigzag winding passage is recovered in the liquid guide passage in which the liquid containing chambers are mutually connected so as to form plural combinations of the descending connection and the ascending connection. As a result, it is more difficult for the bubbles entering into the liquid guide passage to flow to the downstream side.

In the liquid injecting method in the above-described configuration, a liquid residual quantity sensor for outputting different signals between in a case where the liquid guide passage is filled with the liquid and in a case where the liquid guide passage includes air entered thereinto, and wherein the liquid residual quantity sensor may be provided on a more downstream side than the descending connection and the ascending connection in the liquid guide passage.

According to the liquid injecting method in such a configuration, even when the bubbles enter from the liquid containing chambers to the liquid guide passage with which the liquid residual sensor communicates, the bubbles entering to the liquid guide passage can be prevented from reaching the detection position of the liquid residual sensor owing to the zigzag-shaped liquid guide passage, which allows the liquid containing chambers to be mutually connected, or the liquid containing chambers. As a result, the problem that an amount of disposed liquid increases due to an erroneous detection of the liquid residual quantity sensor caused by the bubble inflow can be solved.

A sixth aspect of the invention provides a liquid container detachably mounted on a liquid consuming device, the liquid container comprising: a liquid containing chamber in which the liquid can be contained; a liquid supply hole connectable to the liquid consuming device; a liquid guide passage for guiding the liquid contained in the liquid containing chamber to the liquid supply hole; and an air communicating passage communicating the liquid containing chamber to an air, wherein the liquid containing chamber including at least three liquid containing chambers, and wherein the liquid containing chambers are mutually connected so as to have a descending connection where a pair of the liquid containing chambers are mutually connected so that a liquid flow in the liquid guide passage is a descending flow from above to below and an ascending connection where a pair of the liquid containing chambers are mutually connected so that the liquid flow in the liquid guide passage is an ascending flow from below to above; and wherein an injection port communicating with the liquid containing chamber is formed on the liquid containing chamber positioned on the most upstream side, a predetermined amount of liquid is injected through the injection port, and the injection port is sealed after injecting the liquid.

According to such a configuration, even when the bubbles flow into the liquid guide passage for allowing the liquid containing chambers to communicate with the liquid supply portion, it is difficult for the bubbles entering into the liquid guide passage to flow to the downstream side during the period when usable liquid remains in the liquid guide passage, which allows the liquid containing chambers to communicate with each other, or in the liquid containing chambers. As a result, the liquid can be injected without damaging the original function of the liquid containing chambers due to the bubble inflow.

Since the recovery cost is low and thus the liquid container can be supplied at a low price, the running cost of the liquid consuming device can be reduced.

In the liquid injecting method in the above-described configuration, a plurality of combinations of the descending connection and the ascending connection may be provided.

According to the liquid injecting method in such a configuration, a configuration of the upward and downward zigzag winding passage is recovered in the liquid guide passage in which the liquid containing chambers are mutually connected so as to form plural combinations of the descending connection and the ascending connection. As a result, it is more difficult for the bubbles entering into the liquid guide passage to flow to the downstream side.

In the liquid container with the above-described configuration, a liquid residual quantity sensor for outputting different signals between in a case where the liquid guide passage is filled with the liquid and in a case where the liquid guide passage includes air entered thereinto may be provided on a more downstream side than the descending connection and the ascending connection in the liquid guide passage.

According to the liquid container with such a configuration, when the amount of liquid stored in the liquid containing chambers is consumed to a threshold that is set in advance, a predetermined signal can be output. Even when the bubbles enter from the liquid containing chambers to the liquid guide passage with which the liquid residual quantity sensor communicates, the bubbles entering to the liquid guide passage can be prevented from reaching the detection position of the liquid residual quantity sensor owing to the zigzag-shaped liquid guide passage, which allows the liquid containing chambers to be mutually connected, or the liquid containing chambers. As a result, there can be solved the problem that an amount of disposed liquid increases due to an erroneous detection of the liquid residual quantity sensor caused by the bubble inflow.

In the liquid container with the above-described configuration, the air communicating passage may be provided with an air chamber for preventing the liquid from leaking from the liquid containing chamber.

According to the liquid container having such a configuration, even when the liquid leaks from the liquid containing chambers to atmosphere due to thermal expansion or the like, the air chamber reliably traps, there by preventing the liquid from leaking. Since the liquid trapped in the air chamber is configured to flow into the liquid containing chambers with a consumption of the liquid, the liquid contained in the inside can be used without a waste.

In the liquid container with the above-described configuration, at least a part of the air communicating passage may pass through the uppermost portion in a gravity direction of the liquid container.

According to the liquid container with such a configuration, even when the liquid flows backward, it is difficult for the liquid to reach the air opening hole of the container body beyond the uppermost portion in the gravity direction. As a result, the liquid can be prevented form leaking.

In the liquid container with the above-described configuration, the air communicating passage may be provided with a gas-liquid separating filter for allowing a gas to pass therethrough and preventing a liquid from passing therethrough.

According to the liquid container with such a configuration, even when the liquid flows in the air communicating passage, the liquid does not leak into the air opening hole beyond the gas-liquid separating filter owing to the gas-liquid separating filter provided in the air communicating passage. As a result, the liquid can be further prevented from leaking through the air introducing hole.

In the liquid container with the above-described configuration, the liquid container may be packed in a depressurized pack sealed so that the inner pressure is below the air pressure.

According to the liquid container with such a configuration, since the inner pressure of the liquid container is maintained below a specified value by a negative pressure-sucking force of the depressurized pack before a use, it is possible to supply a liquid in which dissolved air is low.

A seventh aspect of the invention provides a liquid container detachably mounted on a liquid consuming device, the liquid container comprising: a liquid containing chamber in which the liquid can be contained; a liquid supply hole connectable to the liquid consuming device; a liquid guide passage communicating the liquid containing chamber and the liquid supply hole with each other; and an air communicating passage communicating the liquid containing chamber to an air, wherein the liquid containing chamber including at least three liquid containing chambers, wherein the liquid containing chambers are mutually connected so as to have a descending connection where a pair of the liquid containing chambers are mutually connected so that a liquid flow in the liquid guide passage is a descending flow from above to below and an ascending connection where a pair of the liquid containing chambers are mutually connected so that the liquid flow in the liquid guide passage is an ascending flow from below to above; and wherein the liquid container further comprises: a film member forming at least a part of the air communicating passage; and a sealing portion at which an injection port communicated with the liquid containing portion and formed on the film member is sealed.

The liquid container may include a plurality of combinations of the descending connection and the ascending connection.

The liquid container may further comprise a liquid residual quantity sensor for outputting different signals between in a case where the liquid guide passage is filled with the liquid and in a case where the liquid guide passage includes air entered thereinto, and wherein the liquid residual quantity sensor is provided on a more downstream side than the descending connection and the ascending connection in the liquid guide passage.

An eighth aspect of the invention provides a liquid container detachably mounted on a liquid consuming device, the liquid container comprising: a liquid containing chamber in which the liquid can be contained; a liquid supply hole connectable to the liquid consuming device; a liquid guide passage communicating the liquid containing chamber and the liquid supply hole with each other; and an air communicating passage communicating the liquid containing chamber to an air, wherein the liquid containing chamber including at least three liquid containing chambers, wherein the liquid containing chambers are mutually connected so as to have a descending connection where a pair of the liquid containing chambers are mutually connected so that a liquid flow in the liquid guide passage is a descending flow from above to below and an ascending connection where a pair of the liquid containing chambers are mutually connected so that the liquid flow in the liquid guide passage is an ascending flow from below to above; and wherein the liquid container further comprises: a film member forming the liquid containing chamber positioned on the most upstream side and a sealing portion at which an injection port communicated with the liquid containing portion and formed on the film member is sealed.

The liquid container may include a plurality of combinations of the descending connection and the ascending connection.

The liquid container may further comprise a liquid residual quantity sensor for outputting different signals between in a case where the liquid guide passage is filled with the liquid and in a case where the liquid guide passage includes air entered thereinto, and wherein the liquid residual quantity sensor is provided on a more downstream side than the descending connection and the ascending connection in the liquid guide passage.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment suitable for a liquid injection method and a liquid container according to the invention will be described in detail with reference to the drawings.

In the exemplary embodiment described below, as an example of the liquid container, an ink cartridge mounted on an ink jet printing apparatus (printer), which is an example of a liquid ejecting apparatus, will be described.

Figure 1:
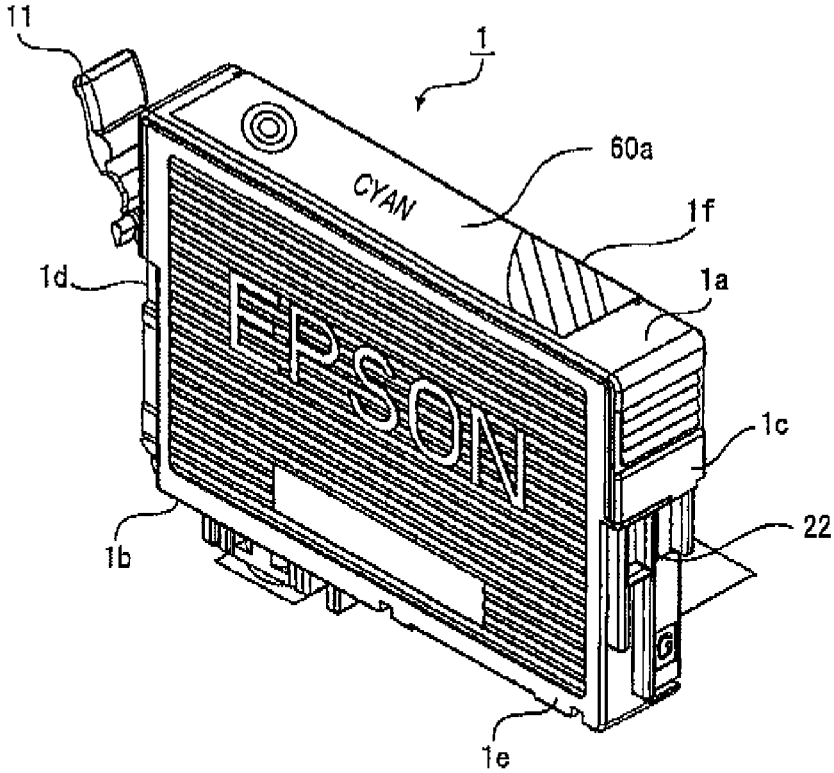
FIG. 1 is an exterior perspective view illustrating an ink cartridge which is an example of a liquid container according to an exemplary embodiment of the invention.
Figure 2:
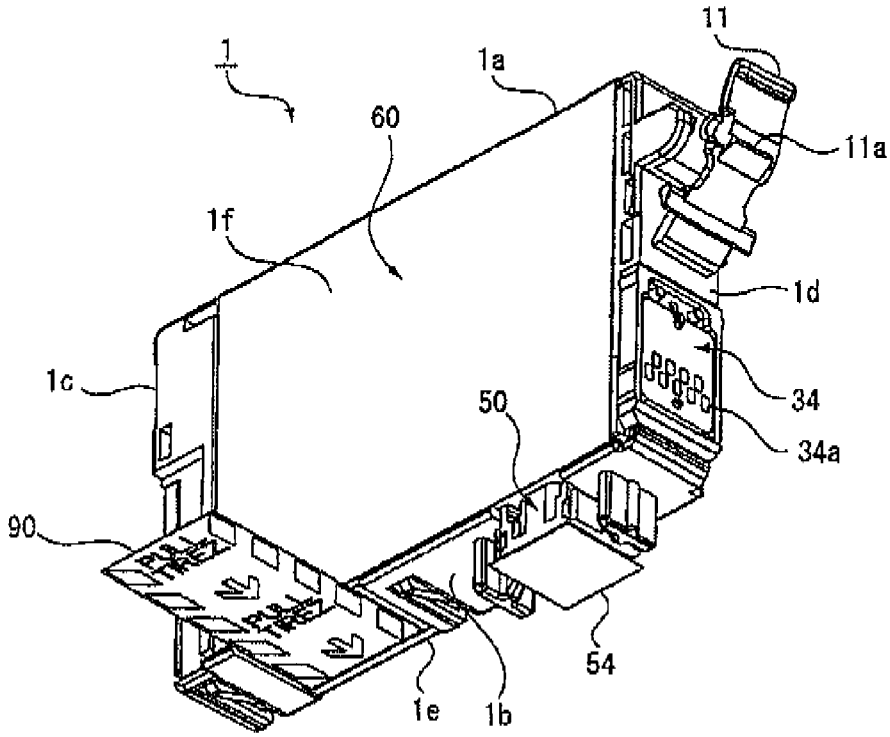
FIG. 2 is an exterior perspective view illustrating the ink cartridge according to the exemplary embodiment of the invention when viewed at an inverse angle in FIG. 1.
Figure 3:
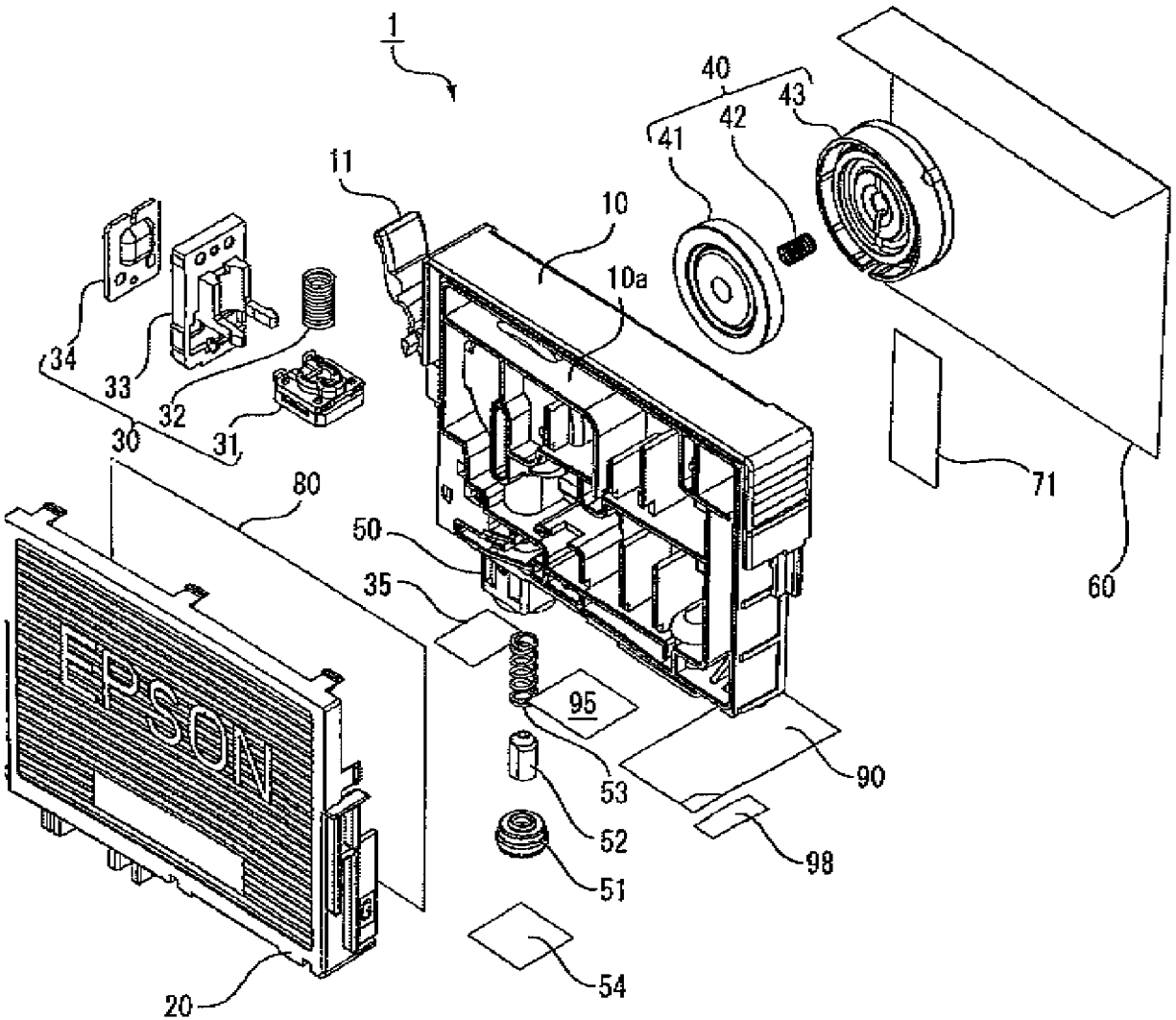
FIG. 3 is an exploded perspective view illustrating the ink cartridge shown in FIG. 1.
Figure 4:
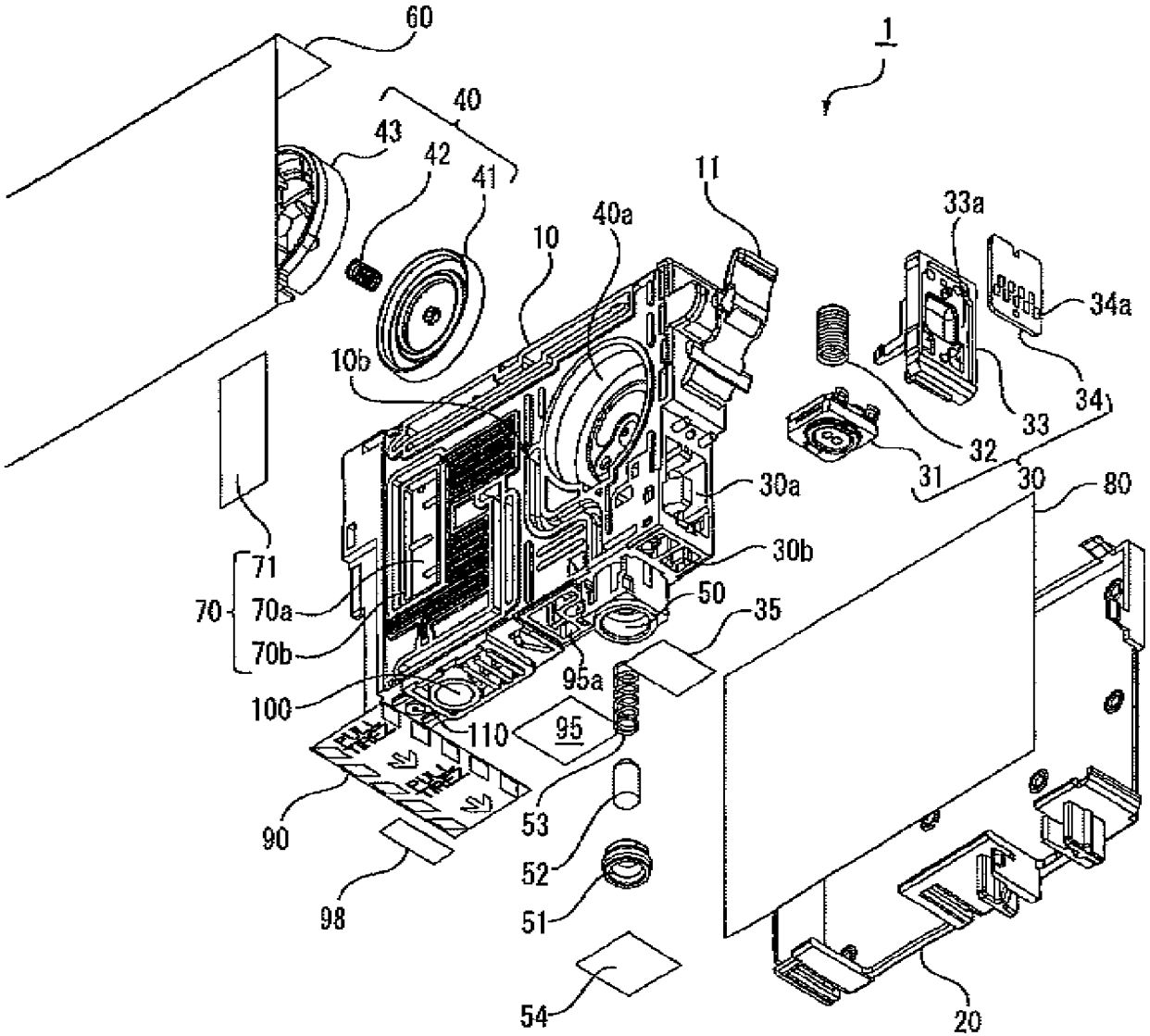
FIG. 4 is an exploded perspective view illustrating the ink cartridge shown in FIG. 3 when viewed at an inverse angle in FIG. 3.
Figure 5:
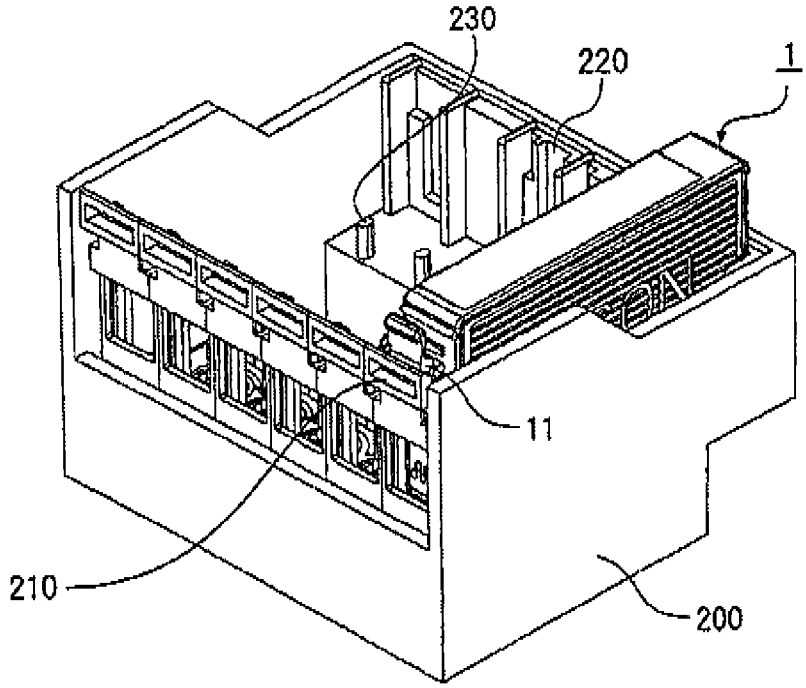
FIG. 5 is a diagram showing the ink cartridge shown in FIG. 1 is mounted on a carriage of the ink jet printing apparatus.
Figure 6:
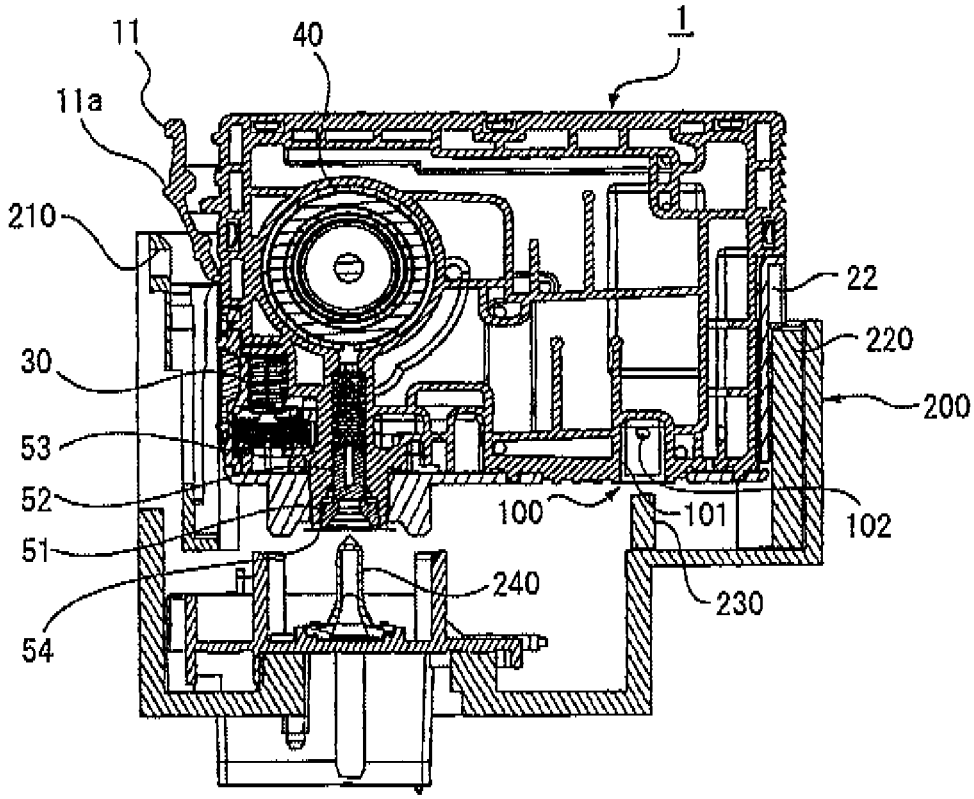
FIG. 6 is a sectional view illustrating the ink cartridge shown in FIG. 1 immediately before the ink cartridge is mounted on the carriage.
Figure 7:
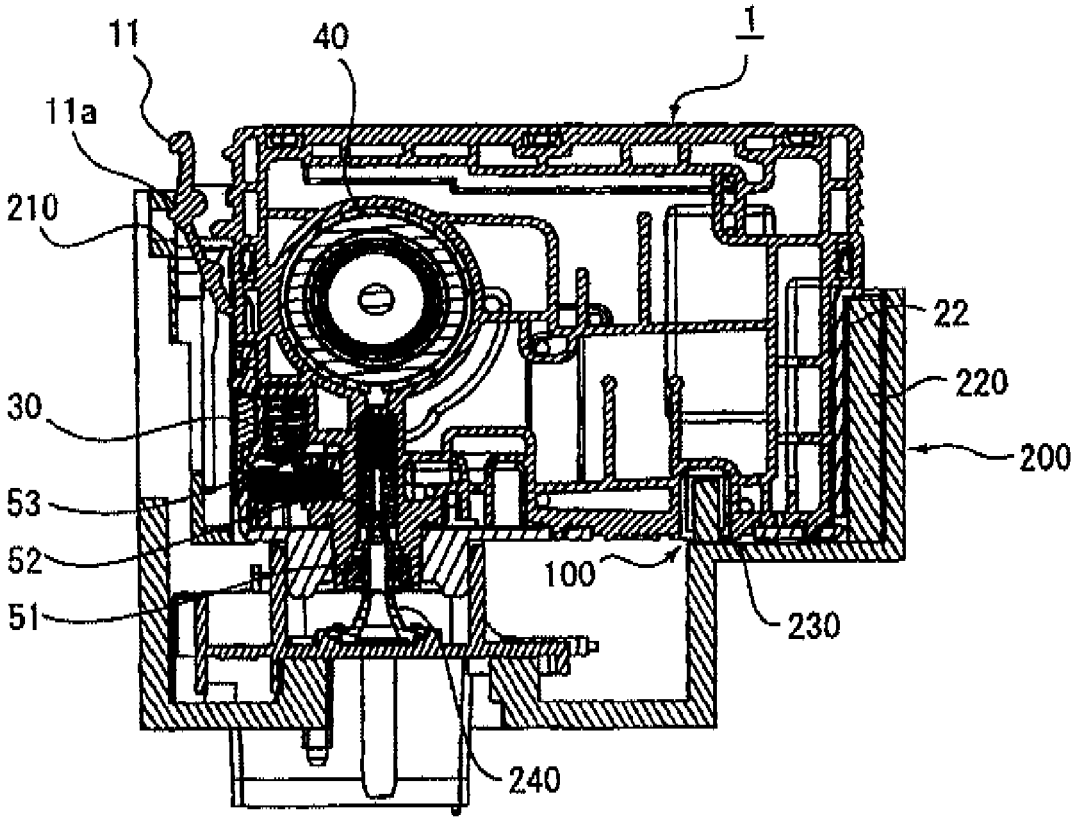
FIG. 7 is a sectional view illustrating the ink cartridge shown in FIG. 1 immediately after the ink cartridge is mounted on the carriage.

FIG. 1 is an exterior perspective view illustrating the ink cartridge that is the liquid container according to the exemplary embodiment of the invention. FIG. 2 is an exterior perspective view illustrating the ink cartridge shown in FIG. 1 when viewed at an inverse angle in FIG. 1. FIG. 3 is an exploded perspective view illustrating the ink cartridge shown in FIG. 1. FIG. 4 is an exploded perspective view illustrating the ink cartridge shown in FIG. 3 when viewed at an inverse angle in FIG. 3. FIG. 5 is a diagram illustrating the ink cartridge shown in FIG. 1 mounted on a carriage of an ink jet printing apparatus. FIG. 6 is a sectional view illustrating the ink cartridge immediately before the ink cartridge is mounted on the carriage. FIG. 7 is a sectional view illustrating the ink cartridge immediately after the ink cartridge is mounted on the carriage.

As shown in FIGS. 1 and 2, an ink cartridge 1 according to the exemplary embodiment has a substantially rectangular parallelepiped shape and is the liquid container for storing/containing ink (liquid) in an ink containing chamber (liquid containing chamber) that is provided therein. The ink cartridge 1 is mounted on a carriage 200 of an ink jet printing apparatus that is an example of a liquid consuming device so as to supply the ink to the ink jet printing apparatus (see FIG. 5).

An exterior appearance of the ink cartridge 1 will be described. As shown in FIGS. 1 and 2, the ink cartridge 1 has a flat upper surface 1*a*, and an ink supply hole 50 that is connected to the ink jet printing apparatus to supply the ink is provided on a bottom surface 1*b* that is opposite the upper surface 1*a*. Further, an air introducing hole 100 for introducing air into the ink cartridge 1 is opened on the bottom surface 1*b*. That is, the ink cartridge 1 serves as an ink cartridge of an open-air type that provides ink from the ink supply hole 50 while introducing the air from the air introducing hole 100.

In the exemplary embodiment, the air introducing hole 100, as shown in FIG. 6, has a substantially cylindrical concave portion 101 that is opened from the bottom surface to the upper surface in the bottom surface 1*b* and a small hole 102 that is opened on the inner circumference surface of the concave portion 101. Since the small hole 102 communicates with an air communicating passage described below, the air is introduced into an upper ink containing chamber 370 (described below) on an uppermost stream side through the small hole 102.

The concave portion 101 of the air introducing hole 100 is formed in a position in which a protrusion 230 formed in the carriage 200 is likely to be inserted. The protrusion 230 serves as a peeling neglect prevention protrusion for preventing neglect of peeling a sealing film 90 that is blocking means of air-tightly blocking the air introducing hole 100. That is, when the sealing film 90 is attached to the air introducing hole 100, the protrusion 230 cannot be inserted into the air introducing hole 100, and thus the ink cartridge 1 is not mounted on the carriage 200. Accordingly, even when a user tries to mount the ink cartridge 1 on the carriage 200 with the sealing film 90 attached to the air introducing hole 100, the ink cartridge 1 cannot be mounted. As a result, when the ink cartridge 1 is mounted, it can be urged to certainly peel the sealing film 90.

As shown in FIG. 1, an erroneous inserting prevention protrusion 22 for preventing the ink cartridge 1 from being mounted on an erroneous position is formed on a narrow side surface 1*c* adjacent to one end side of the upper surface 1*a* of the ink cartridge 1. As shown in FIG. 5, an uneven portion 220 corresponding to the erroneous inserting prevention protrusion 22 is formed on the carriage 200 which serves as a receiver. The ink cartridge 1 is mounted on the carriage 200 only when the erroneous inserting prevention protrusion 22 and the uneven portion 220 are not interfered with each other. The erroneous inserting prevention protrusion 22 has a different shape depending on each kind of ink, and thus the uneven portion 220 on the carriage 200 which serves as the receiver has also a different shape depending on the corresponding kind of ink. As a result, even when the plurality of ink cartridges is mounted on the carriage 200, as shown in FIG. 5, the ink cartridges is not mounted on erroneous positions.

As shown in FIG. 2, an engagement lever 11 is provided on a narrow side surface 1*d* that is opposite the narrow side surface 1*c* of the ink cartridge 1. A protrusion 11*a* that is engaged with a concave portion 210 formed in the carriage 200 when the ink cartridge 1 is mounted to the carriage 200 is formed below the engagement lever 11. Moreover, the protrusion 11*a* and the concave portion 210 are engaged with each other with the engagement lever 11 bent so that the ink cartridge 1 is fixed on the carriage 200.

A circuit board 34 is provided below the engagement lever 11. A plurality of electrode terminals 34*a* are formed on the circuit board 34. Since the electrode terminals 34*a* comes in contact with an electrode member (not shown) provided in the carriage 200, the ink cartridge 1 is electrically connected to the ink jet printing apparatus. A nonvolatile memory capable of rewriting data is provided in the circuit board 34. Various data about the ink cartridge 1, ink use data of the ink jet printing apparatus, or the like are memorized in the nonvolatile memory. An ink residual quantity sensor 31 (liquid residual quantity sensor) (see FIG. 3 or 4) that outputs different signals depending on an amount of ink remaining in the ink cartridge 1 is provided in the back of the circuit board 34. Hereinafter, the ink residual quantity sensor 31 and the circuit board 34 are called an ink end sensor 30.

As shown in FIG. 1, a label 60*a* for denoting a content of an ink cartridge is attached to the upper surface 1*a* of the ink cartridge 1. The edge of an outer surface film 60 that covers a wide side surface if is extended and attached to the upper surface 1*a* so that the label 60*a* is formed.

As shown in FIGS. 1 and 2, the wide surfaces 1*e* and 1*f* adjacent two long sides of the upper surface 1*a* of the ink cartridge 1 are formed in a flat surface shape. Hereinafter, a side of the wide surface 1*e*, a side of the wide surface 1*f*, a side of the narrow surface 1*c*, and a side of the narrow surface 1*d* denote a front surface, a rear surface, a right surface, and a left surface, respectively, for convenience' sake.

Next, each portion constituting the ink cartridge 1 will be described with reference to FIGS. 3 and 4.

The ink cartridge 1 has a cartridge body 10 that is the container body and a cover member 20 that covers the front surface of the cartridge body 10.

Various-shaped ribs 10*a* are formed in the front surface of the cartridge body 10. The ribs 10*a* are partitioned so as to form a plurality of ink containing chambers (liquid containing chambers) that fill with the ink I, a non-containing chamber that does not fill with ink, an air chamber that is positioned in the air communicating passage 150 described below, and so on in the inside of the cartridge body 10.

A film 80 that covers the front surface of the cartridge body 10 is provided between the cartridge body 10 and the cover member 20. The upper surfaces of the ribs, concave portions, and grooves are blocked by the film 80 so as to form a plurality of flow passages, the ink containing chambers, the non-containing chamber, and the air chamber.

In the rear surface of the cartridge body 10, a concave-shaped differential pressure valve accommodating chamber 40*a* configured as a concave portion for accommodating a differential pressure valve 40 and a gas-liquid separating chamber 70*a* configured as a concave portion for constituting a gas-liquid separating filter 70 are formed.

A valve member 41, a spring 42, and a spring seat 43 are accommodated in the differential pressure valve accommodating chamber 40*a* and constitute the differential pressure valve 40. The differential pressure valve 40 is disposed between the ink supply portion 50 positioned on the downstream and the ink containing chamber positioned on the upstream, and is urged to a closed state in which the ink flow from a side of the ink containing chamber to a side of the ink supply portion 50 is blocked. The differential pressure valve 40 is configured so that when a differential pressure between the side of the ink containing chamber and the side of the ink supply portion 50 becomes a predetermined value or more depending on ink supply from the ink supply portion 50 to the printer, the differential valve 40 is changed from the closed state to the opened state and the ink I is supplied to the ink supply portion 50 while negative pressure is applied to the ink I.

On the upper surface of the gas-liquid separating chamber 70*a*, a gas-liquid separating membrane 71 is attached along a bank 70*b* surrounding an outer circumference provided in the vicinity of the middle portion of the gas-liquid separating chamber 70*a*. The gas-liquid separating membrane 71 is made of a material that passes a gas while not passing a liquid. The gas-liquid separating membrane 71 constitutes the gas-liquid separating filter 70. The gas-liquid separating filter 70 that is provided within the air communicating passage 150 allows the air introducing hole 100 to connect to the ink containing chamber and allows the ink I in the ink containing chamber not to leak to the air introducing hole 100 through the air communicating passage 150.

In addition to the differential pressure accommodating chamber 40*a* and the gas-liquid separating chamber 70*a*, a plurality of grooves 10*b* are caved in the rear surface of the cartridge body 10. Since the outer surface film 60 covers the outer surface in a state where the differential pressure valve 40 and the gas-liquid separating filter 70 are formed, the opening of each groove 10*b* is blocked, and thus the air communicating passage 150 or the ink guide passage (liquid guide passage) is formed.

As shown in FIG. 4, a sensor chamber 30*a* that is configured as a concave portion for accommodating each member constituting the ink end sensor 30 is formed in the right surface of the cartridge body 10. The ink residual quantity sensor 31 and a compressing spring 32 for pressing the residual quantity sensor 31 against the inner wall of the sensor chamber 30*a* are accommodated in the sensor chamber 30*a*. The opening of the sensor chamber 30*a* is covered with a cover member 33 and the circuit board 34 is fixed on an outer surface 33*a* of the cover member 33. A sensing member of the ink residual quantity sensor 31 is connected to the circuit board 34.

The ink residual quantity sensor 31 includes a cavity forming a part of the ink guide path between the ink containing chamber and the ink supply portion 50, a vibrating plate forming a part of the wall surface of the cavity, and a piezoelectric element (piezoelectric actuator) allowing vibration to be applied onto the vibrating plate. The ink residual quantity sensor 31 outputs residual vibration at the time of applying the vibration onto the vibrating plate to the ink jet printer as signals. Then the liquid residual detection unit of the ink jet printer detects a difference in an amplitude, a frequency, or the like of the residual vibration between the ink I and the gas (bubble B mixed in the ink) based on the signals output from the ink residual quantity sensor 31 so as to detect whether the ink I exists in the cartridge body 10.

Specifically, when the ink I of the ink containing chamber in the cartridge body 10 is exhausted or is lowered to a predetermined amount, air introduced into the ink containing chamber passes through the ink guide path and enter into the cavity of the ink residual quantity sensor 31. At this time, the liquid residual detection unit of the ink jet printer detects the change in the amplitude or the frequency of the residual vibration based on the signals output from the ink residual quantity sensor 31 and outputs an electrical signal for denoting the ink end or ink near end.

In addition to the ink supply hole 50 and the air introducing hole 100 described above, as shown in FIG. 4, a depressurization hole 110 used to depressurize the ink cartridge 1 by sucking up air from the inside thereof through vacuuming means when the ink is injected, a concave portion 95*a* constituting the ink guide passage from the ink containing chamber to the ink supply hole 50, and a buffer chamber 30*b* provided below the ink end sensor 30 are provided on the bottom surface of the cartridge body 10.

Immediately after the ink cartridge is manufactured, openings of the ink supply hole 50, the air introducing hole 100, the depressurization hole 110, the concave portion 95*a*, and the buffer chamber 30*b* are sealed by sealing films 54, 90, 98, 95, and 35, respectively. The sealing film 90 for sealing the air introducing hole 100 is peeled by a user before the ink cartridge is mounted on the ink jet printing apparatus before a use. Accordingly, the air introducing hole 100 is exposed to the outside so that the ink containing chamber in the ink cartridge 1 communicates with open air through the air communicating passage 150.

The sealing film 54 attached to the outer surface of the ink supply hole 50, as shown in FIGS. 6 and 7, is configured so as to be torn by an ink supply needle 240 of the ink jet printing apparatus when mounted on the ink jet printing apparatus.

As shown in FIGS. 6 and 7, a ring-shaped sealing member 51 that is pressed against the outer surface of the ink supply needle 240 when the ink cartridge is mounted on a printer, a spring seat 52 that comes in contact with the sealing member 51 to block the ink supply hole 50 when the ink cartridge is not mounted on the printer, and a compressing spring 53 that urges the spring seat 52 in a direction of a contact with the sealing member 51 are provided within the ink supply hole 50.

As shown in FIGS. 6 and 7, when the ink supply needle 240 is inserted into the ink supply hole 50, the inner circumference of the sealing ember 51 and the outer circumference of the ink supply needle 240 are sealed with each other, and a gap between the ink supply hole 50 and the ink supply needle 240 is sealed liquid-tightly. In addition, the front end of the ink supply needle 51 comes in contact with the spring seat 52 to push up the spring seat 52. Accordingly, since the spring seat 52 and the sealing member 51 are released from each other, the ink I can be supplied from the ink supply hole 50 to the ink supply needle 240.

Next, the inner configuration of the ink cartridge 1 according to the exemplary embodiment will be described with reference to the FIGS. 8 to 12.

Figure 8:
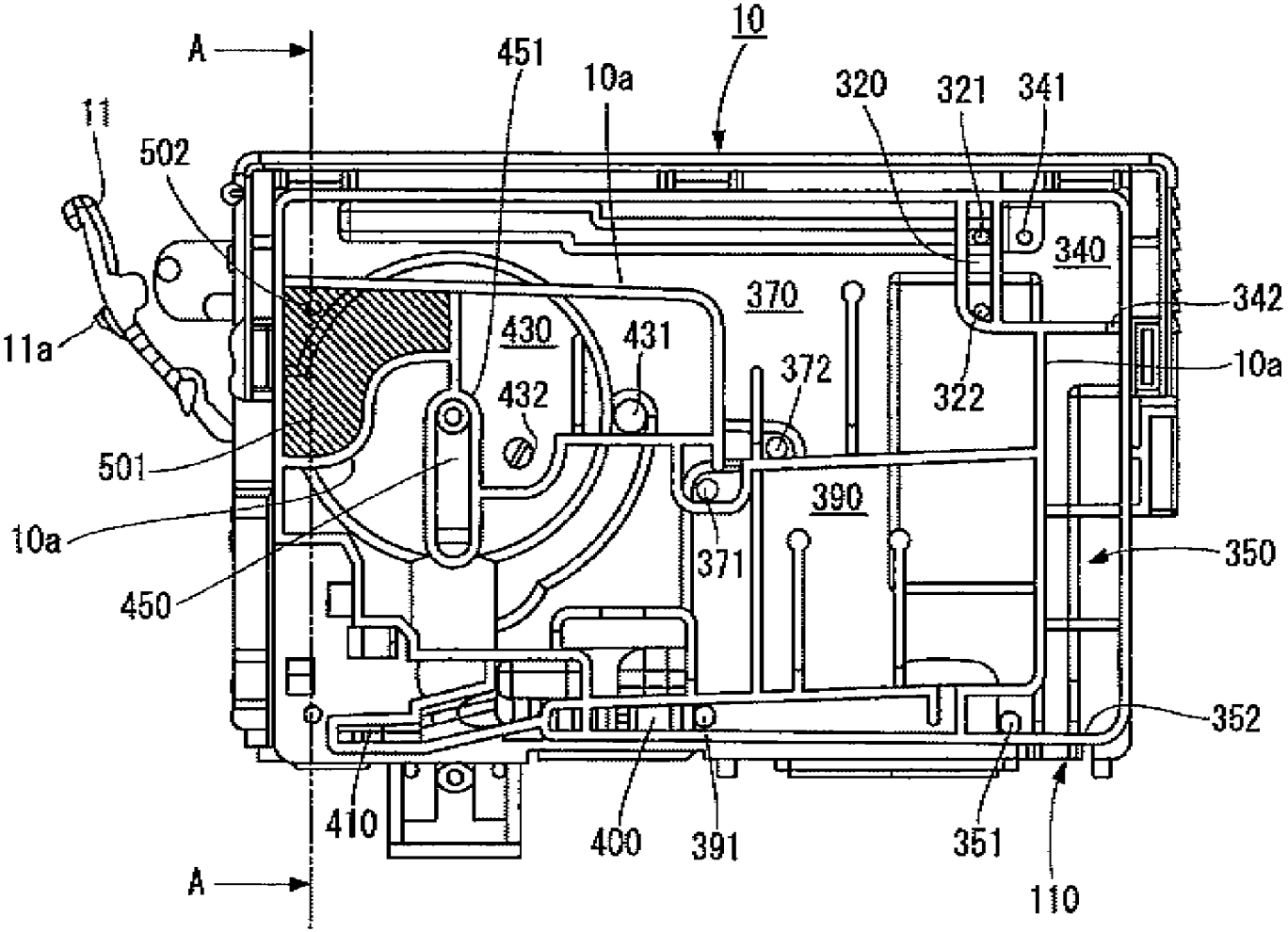
FIG. 8 is a diagram illustrating the cartridge body of the ink cartridge shown in FIG. 1 when viewed from the front surface.
Figure 9:
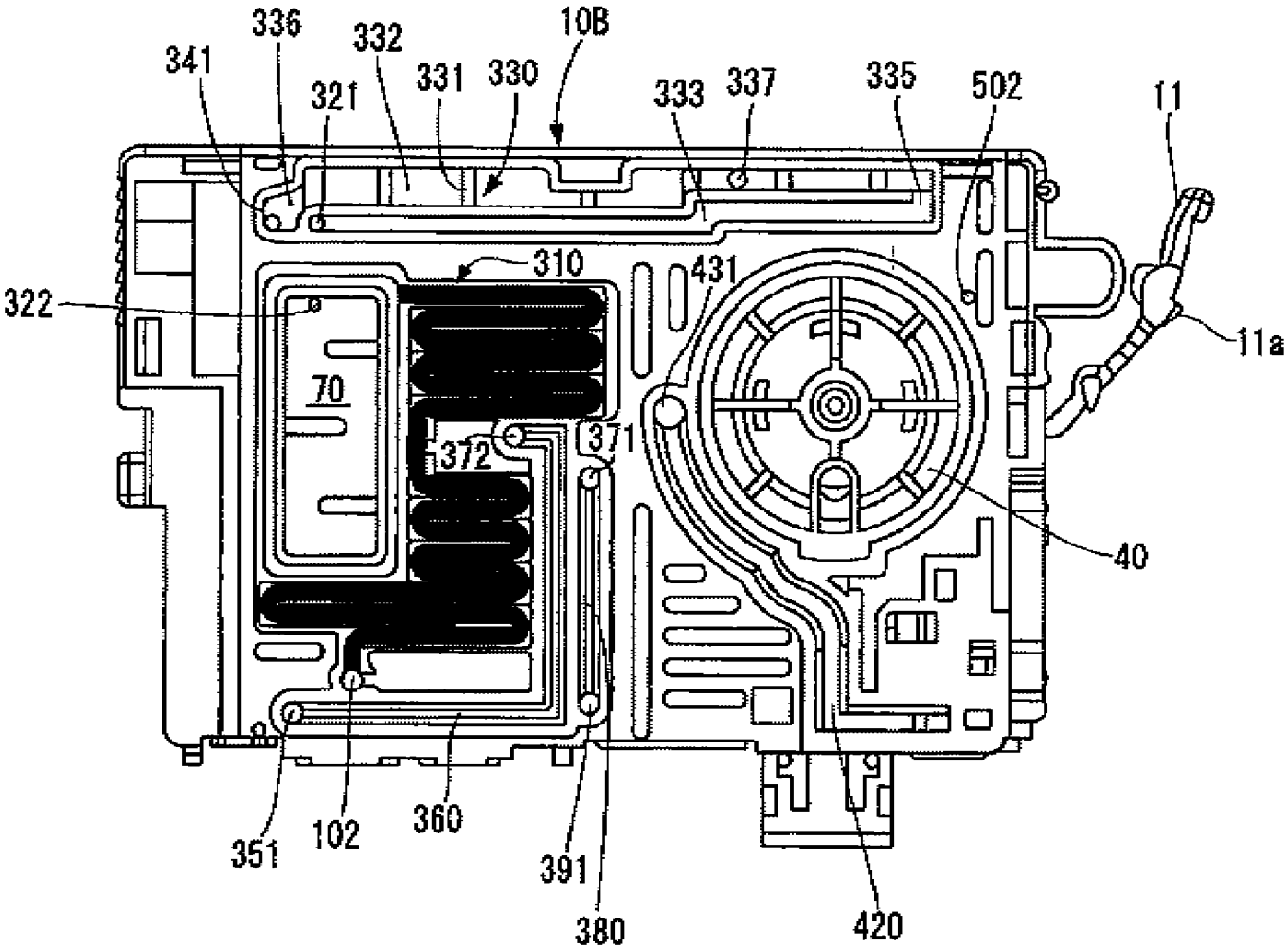
FIG. 9 is a diagram illustrating the cartridge body of the ink cartridge shown in FIG. 1 when viewed from the rear.
Figure 10:
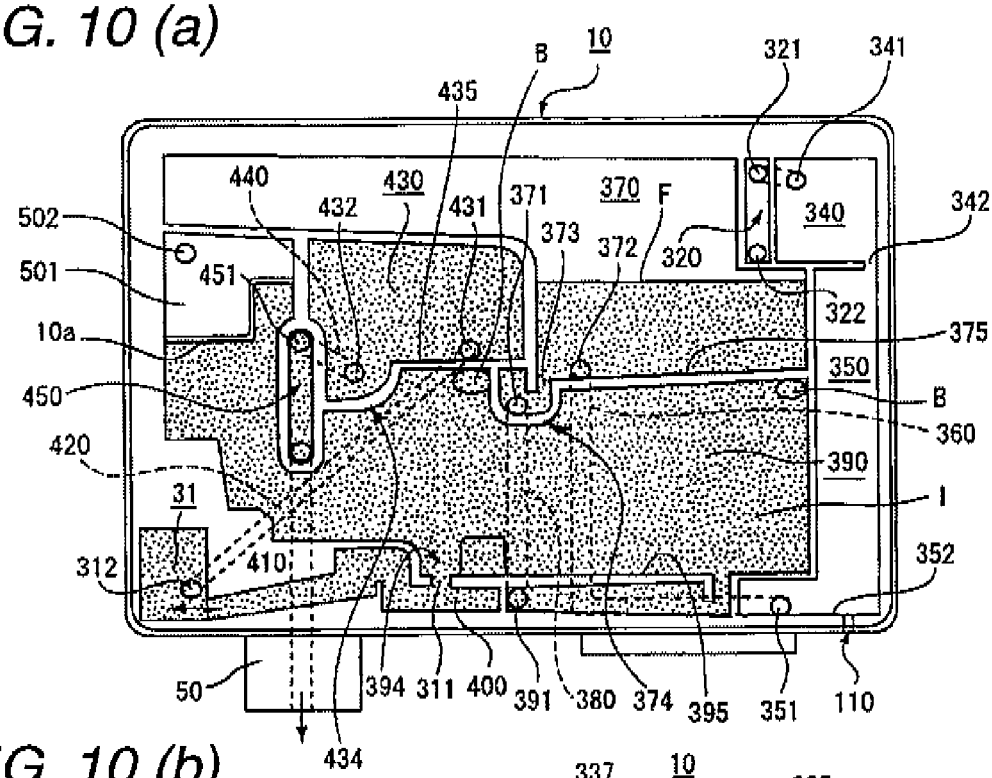
FIGS. 10(*a*) and 10(*b*) are schematic diagrams of the FIG. 8 and the FIG. 9, respectively.
Figure 10:
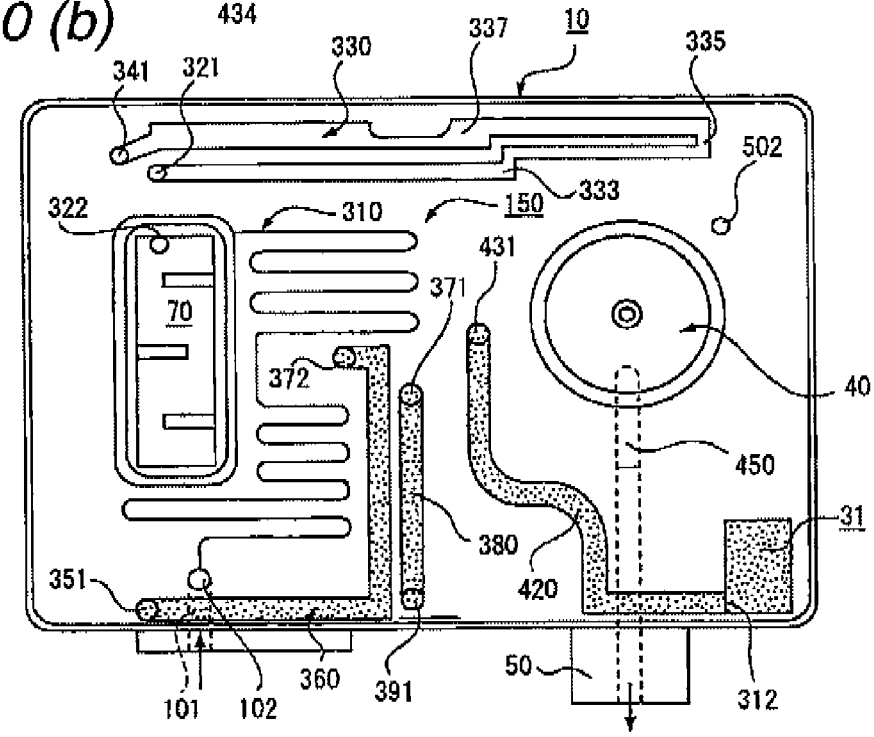
Figure 11:
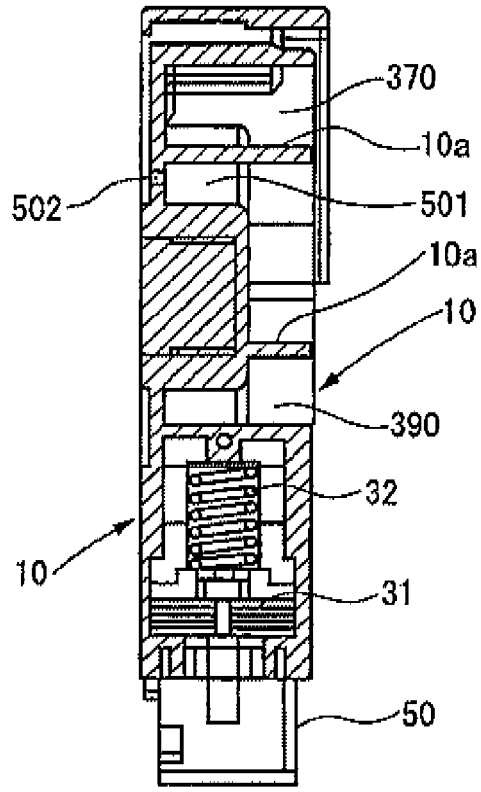
FIG. 11 is a sectional view illustrating the cartridge body taken along the line A-A of FIG. 8.
Figure 12:
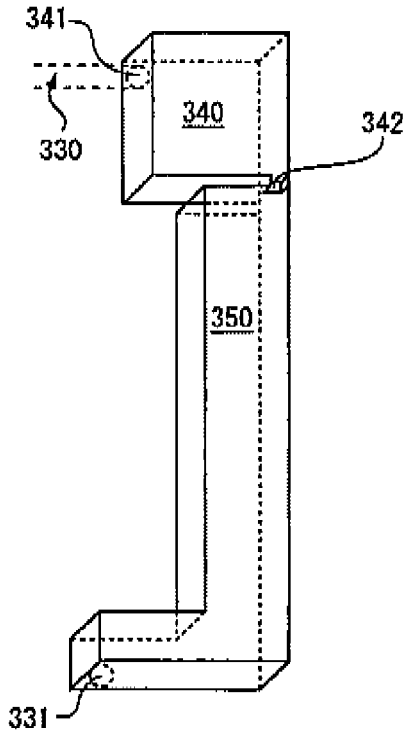
FIG. 12 is a partially enlarged perspective view illustrating a part of a configuration of a flow passage in the cartridge body shown in FIG. 8.

FIG. 8 is a diagram illustrating the cartridge body 10 of the ink cartridge 1 when viewed from the front surface. FIG. 9 is a diagram illustrating the cartridge body 10 of the ink cartridge 1 when viewed from the rear. FIGS. 10(*a*) and 10(*b*) are schematic diagrams of the FIG. 8 and the FIG. 9, respectively. FIG. 11 is a sectional view illustrating the cartridge body 10 taken along the line A-A of FIG. 8. FIG. 12 is a partially enlarged perspective view illustrating a flow passage shown in FIG. 8.

In the ink cartridge 1, three ink containing chambers, that is, the upper ink containing chamber 370 and a lower ink containing chamber 390 into which a primary ink containing chamber filled with the ink I are divided, and the buffer chamber 430 which is positioned so as to be interposed therebetween are formed in the front surface of the cartridge body 10 (see FIG. 10).

Further, in the rear surface of the cartridge body 10, the air communicating passage 150 for allowing air to introduce into the upper ink containing chamber 370, which is the ink containing chamber on the uppermost stream, with a consumption amount of the ink I.

The ink containing chambers 370 and 390 and the buffer chamber 430 are partitioned by a rib 10*a*. In each ink containing chamber, recesses 374, 394, and 434 having a caved-in shape downward are formed in a part of the rib 10*a* that horizontally extend so as to form bottom wall of the ink containing chambers.

The recess 374 is formed in the manner that a part of a bottom wall 375 formed by the rib 10*a* of the upper ink containing chamber 370 is caved in downward. The recess 394 is formed in the manner that a bottom wall 395 formed by the rib 10*a* of the lower ink containing chamber 390 and a bulge of the wall surface are swollen in a thickness-wise direction of the cartridge. The recess 434 is formed in the manner that a part of a bottom wall 435 formed by the rib 10*a* of the buffer chamber 430 is caved in downward.

Moreover, ink discharging ports 371, 311, and 432 that communicate with the ink guide passage 380, an upstream ink end sensor connecting passage 400, and an ink guide passage 440 are provided in bottom portions or the vicinity of the recesses 374, 394, and 434, respectively.

The ink discharging ports 371 and 432 are through-holes that are pierced through each wall surface of the corresponding ink containing chamber in the thickness-wise direction of the cartridge body 10. In addition, the ink discharging port 312 is an outlet port of the cavity (flow passage) in the ink residual quantity sensor 31.

One end of the ink guide passage 380 communicates with the ink discharging port 371 of the upper ink containing chamber 370 while the other end thereof communicates with an ink inflow port 391 provided in the lower ink containing chamber 390. In this way, the ink guide passage 380 serves as a communicating flow passage for guiding the ink in the upper ink containing chamber 370 to the lower ink containing chamber 390. The ink guide passage 380 is provided to extend from the ink discharging port 371 of the upper ink containing chamber 370 vertically downward. In addition, a pair of the ink containing chambers 370 and 390 are mutually connected so that a liquid flow is a descending connection from above to below in the liquid guide passage.

One end of the ink guide passage 420 communicates with the ink discharging port 312 of the cavity in the ink residual quantity sensor 31 while the other end thereof communicates with an ink inflow port 431 provided in the buffer chamber 430. Accordingly, the ink guide passage 420 guides the ink in the lower ink containing chamber 390 to the buffer chamber 430 through the upstream ink end sensor connecting passage 400. The ink guide passage 420 is provided so as to extend obliquely upward from the ink discharging port 312 of the cavity in the ink residual quantity sensor 31. In addition, a pair of the ink containing chambers 390 and 430 are mutually connected so that the liquid flow is an ascending connection from below to above in the liquid guide passage.

That is, in the cartridge body 10 shown in the drawings, the three ink containing chambers 370, 390, and 430 are mutually connected in series so that the liquid flows are the descending connection and the ascending connection.

The ink guide passage 440 serves as an ink flow passage that guiding the ink from the ink discharging port 432 of the buffer chamber 430 to a differential valve 40.

The ink in flow ports 372, 391 and 431 of the ink containing chambers are provided so as to be positioned in the vicinities of the bottom walls 375, 395, and 435 of the ink containing chambers.

Hereinafter, the ink guide passage from the upper ink containing chamber 370, which is a primary ink containing chamber, to the ink supply hole 50 will be described below with reference to FIGS. 8 to 12.

On the uppermost stream (the uppermost portion) in the cartridge body 10, as shown in FIG. 8, the upper ink containing chamber 370 is formed on the front surface of the cartridge body 10. The upper ink containing chamber 370 occupies about the half of an ink containing area of the ink containing chambers and is formed above the substantial half of the cartridge body 10. The ink discharging port 371 that communicates with the ink guide passage 380 is opened in the recess 374 of the bottom wall 375 of the upper ink containing chamber 370. The ink discharging port 371 is positioned below the bottom wall of the upper ink containing chamber 370. Even when an ink level in the upper ink containing chamber 370 falls to the bottom wall, the ink discharging port 371 is positioned lower than the ink level. Accordingly, the ink I continues to be stably discharged.

As shown in FIG. 9, the ink guide passage 380 that is formed on the rear surface of the cartridge body 10 guides the ink from the upside to the lower ink containing chamber 390.

The lower ink containing chamber 390 is an ink containing chamber into which the ink I stored in the upper ink containing chamber 370 is imported. Moreover, as shown in FIG. 8, the lower ink containing chamber 390 occupies about the half of the ink contained area of the ink containing chambers formed on the front surface of the cartridge body 10, and is formed below the substantial half of the cartridge body 10. The ink inflow port 391 that communicates with the ink guide passage 380 is opened to a communicating flow passage disposed below the bottom wall 395 of the lower ink containing chamber 390 in the vicinity of the rib 10*a* that is the bottom wall of the lower ink containing chamber 390. Accordingly, the ink I flows in from the upper ink containing chamber 370 through the communicating flow passage.

The lower ink containing chamber 390 communicates with the upstream ink end sensor connecting passage 400 through the ink discharging port 311 that is pierced through the bottom wall 395. A three-dimensional labyrinthine passage is formed in the upstream ink end sensor connecting passage 400. Moreover, the labyrinthine passage is configured to trap the bubbles or the like that flow in before the ink end so that the bubbles or the like flow toward the downstream.

The upstream ink end sensor connecting passage 400 communicates with a downstream ink end sensor connecting passage 410 through a through-hole (not shown). Moreover, the ink I is guided to the ink residual quantity sensor 31 through the downstream ink end sensor connecting passage 410.

The ink I guided to the ink residual quantity sensor 31 passes through the cavity (flow passage) within the ink residual quantity sensor 31 and is guided from the ink discharging port 312, which is an outlet port of the cavity, to the ink guide passage 420, which is formed on the rear surface of the cartridge body 10. The ink guide passage 420 is formed so as to guide the ink obliquely upward from the ink residual quantity sensor 31 and is connected to the ink inflow port 431 that communicates with the buffer chamber 430. Accordingly, the ink that comes out of the ink residual quantity sensor 31 is guided to the buffer chamber 430 through the ink guide passage 420.

The buffer chamber 430 is a small room that is partitioned by the rib 10*a* between the upper ink containing chamber 370 and the lower ink containing chamber 390 and is configured as a space for storing the ink immediately before the differential pressure valve 40. The buffer chamber 430 is formed so as to be opposite the rear side of the differential pressure valve 40. Accordingly, the ink I flows in the differential pressure valve 40 through the ink guide passage 440 that communicates with the ink discharging port 432 formed in the recess 434 of the buffer chamber 430.

The ink that flows in the differential pressure valve 40 is guided to the downstream side by the differential pressure valve 40, and then is guided to an outlet flow passage 450 through a through-hole 451. Since the outlet flow passage 450 communicates with the ink supply hole 50, the ink I is supplied to the ink jet printing apparatus through the ink supply needle 240 inserted into the ink supply hole 50.

Next, the air communicating path 150 from the air introducing hole 100 to the upper ink containing chamber 370 will be described with reference to FIGS. 8 to 12.

When an inner pressure of the ink cartridge 1 is reduced with a consumption of the ink I in the ink cartridge 1, air (gas) flows from the air introducing hole 100 to the upper ink containing chamber 370 as much as a reduced amount of the stored ink I.

A small hole 102 that is provided in the air introducing hole 100 communicates with an one end of a meandering passage 310 formed on the rear side surface of the cartridge body 10. The meandering passage 310 is formed lengthwise and extends narrowly from the air introducing hole 100 to the upper ink containing chamber 370 to prevent moisture of ink from evaporating. Further, the other end of the meandering passage 310 is connected to the gas-liquid separating filter 70.

A through-hole 322 is formed on a bottom surface of the gas-liquid separating chamber 70*a* constituting the gas-liquid separating filter 70, and communicates with a space 320 formed on the front side surface of the cartridge body 10 through the through-hole 322. In the gas-liquid separating filter 70, the gas-liquid separating membrane 71 is disposed between the through-hole 322 and the other end of the meandering passage 310. The gas-liquid separating membrane 71 has a meshed shape formed of a textile material that has a high water repellent property and high oil repellent property.

The space 320 is formed on the right upper portion of the upper ink containing chamber when viewed from the front surface of the cartridge body 10. In the space 320, a through-hole 321 is opened above the through-hole 322. The space 320 communicates with an upper connection passage 330 formed on the rear side surface through the through-hole 321.

The upper connection passage 330 has partial flow passages 333 and 337. The partial passage 333 extends from the through-hole 321 along the long side in the right direction, when viewed from the rear side surface, so as to pass through the uppermost surface of the ink cartridge 1, that is, the uppermost portion in the gravity direction in a state where the ink cartridge 1 is mounted. The partial passage 337 is reversed in a reverse portion 335 at the vicinity of the short side, passes through the upper surface of the ink cartridge 1, and extends up to a through-hole 341 formed at the vicinity of the through-hole 321. Further, the through-hole 341 communicates with the ink trap chamber 340 formed on the front side surface.

When the upper connection passage 330 is viewed from the rear side surface, a position 336 in which the through-hole 341 is formed and a concave portion 332 which is caved more deeply than the position 336 in the thickness-wise direction of the ink cartridge are provided in the partial passage 337 that extends from the reverse portion 335 to the through-hole 341. A plurality of ribs 331 are formed to partition the concave portion 332. The partial passage 333 that extends from the through-hole 321 to the reverse portion 335 is formed to be shallower than the partial passage 337 that extends the reverse portion 335 to the through-hole 341.

In the ink cartridge 1, since the upper connection passage 330 is formed in the uppermost portion in the gravity direction, the ink I does not normally flow to the air introducing hole 100 by passing through the upper connection passage 330. Moreover, the upper connection passage 330 has as a wide thickness much as the ink I does not flow backward by the capillary phenomenon or the like, and the concave portion 332 is formed in the partial passage 337. Accordingly, it is easy to trap the ink I that flows backward.

The ink trap chamber 340 is a rectangular parallelepiped space that is formed at the corner of the right upper portion of the cartridge body 10 when viewed from the front surface. As shown in FIG. 12, the through-hole 341 is opened in the vicinity of an inner corner of the left upper portion of the ink trap chamber 340 when viewed from the front side surface. Further, a notch 342 is formed at a front corner of the right lower portion of the ink trap chamber 340 in the manner that a part of the rib 10*a*, which serves as a wall, is notched. Accordingly, the ink trap chamber 340 communicates with the connecting buffer chamber 350 through the notch 342. The ink trap chamber 340 and the connecting buffer chamber 350 are air chambers that are provided so as to expand a capacity in the air communicating passage 150. Even when the ink I flows backward from the upper ink containing chamber 370, the ink trap chamber 340 and the connecting buffer chamber 350 are configured to hold the ink I so that the ink I does not flow into the air introducing hole 100 as much as possible. The specific role of the ink trap chamber 340 and the connecting buffer chamber 350 will be described below.

The connecting buffer chamber 350 is a space that is formed below the ink trap chamber 340. A depressurization hole 110 for extracting air when ink is injected is provided on the bottom surface 352 of the connecting buffer chamber 350. The through-hole 351 is opened in the thickness-wise direction in the vicinity of the bottom surface 352 and in the downmost portion in the gravity direction when mounted on the ink jet printing apparatus. Accordingly, the connecting buffer chamber 350 communicates with a connecting passage 360 formed on the rear surface through the through-hole 351.

The connecting passage 360 extends in a middle upward direction when viewed from the rear surface, and communicates with the upper ink containing chamber 370 through a through-hole 372 opened in the vicinity of the bottom wall of the upper ink containing chamber 370. The air communicating passage 150 of the ink cartridge 1 is constituted by constituents from the air introducing hole 100 to the connecting passage 360. In the connecting passage 360, a meniscus is as slimly formed as a flow backward flow of the ink I does not occur.

In the ink cartridge 1, as shown in FIG. 8, the non-containing chamber 501 that does not contain the ink I is partitioned on the front surface of the cartridge body 10, in addition to the ink containing chambers (the upper ink containing chamber 370 and 390 and the buffer chamber 430), the air chambers (the ink trap chamber 340 and the connecting buffer 350), and the ink guide passages (the upstream ink end sensor connecting passage 400 and the downstream ink end sensor connecting passage 410) described above.

When viewed from the front surface of the cartridge body 10, the non-containing chamber 501 is partitioned in an area close to the hatched left side surface so as to be inserted between the upper ink containing chamber 370 and the lower ink containing chamber 390. In addition, in the non-containing chamber 501, an air introducing hole 502 pierced through the rear surface is provided at the left upper corner in the inner area thereof so as to communicate with open air through the air introducing hole 502.

When the ink cartridge 1 is depressurized and packed, the non-containing chamber 501 serves as a deaerating chamber in which a deaerating negative pressure is accumulated.

Even in the ink cartridge 1 described above, for example, when the ink cartridge 1 separated from the carriage 200 during the use falls down or when the ink level of the ink containing chambers 370, 390, and 430 is shaken due to the outside vibration or the like in a state where the ink cartridge 1 is mounted on the carriage 200, an air may come in contact with the ink containing chambers through the ink discharging port in the ink containing chambers in which the small amount of the ink remains. Accordingly, the bubble B may enter into the ink guide passage that communicates with the ink discharging port.

However, according to the configuration of the above-described ink cartridge 1, the three ink containing chambers 370, 390, and 430 are mutually connected so as to form the descending connection and the ascending connection. In this way, since the liquid guide passage to the ink supply hole 50 is configured to have the upward and downward winding passage, the ink I remaining in the descending liquid guide passage serves as the barrier wall that prevents the bubble B from flowing to the downstream side. For this reason, it is difficult for the bubble B entering into the ink guide passage to flow into the downstream side.

When the ink cartridge 1 separated from the carriage 200 is overturned, the ink guide passage of the ascending connection serves as the descending connection to block the downstream movement of the bubbles. That is, even when the top and bottom of the ink cartridge 1 is overturned, the descending connection enables the downstream movement of the bubbles to be blocked.

The ink containing chambers 390 and 430 that are connected in the second and subsequent stages function as the trapping space for trapping the bubbles flowing from the upper ink containing chamber 370 on the upstream side. For example, when the ink cartridge 1 falls sideward, the flow passage extending in an up and down direction extends in a horizontal direction. At this time, the descending connection of the mutually ink containing chambers does not sufficiently block the movement of the bubbles. However, even when such a case occurs, the upper spaces of the ink containing chambers 390 and 430 effectively function as the trapping space for trapping the inflow bubbles. Moreover, the ink I remaining in the ink containing chamber 390 and 430 serve as the barrier wall for blocking the downstream movement of the bubbles. As a result, the bubbles are reliably prevented from moving to the downstream side.

The bubble B may enter from the upper ink containing chamber 370 to the ink guide passage 380. However, as long as the usable ink remains in the downward winding ink guide passage 380 for allowing the ink containing chambers to communicating with each other or in the ink containing chamber 390, the bubble B entering into the ink guide passage can be prevented from reaching the detection position of the ink residual quantity sensor 31. As a result, the problem that an amount of disposed liquid increases due to an erroneous detection of the ink residual quantity sensor 31 caused by the bubble inflow can be solved.

In the above-described ink cartridge 1, three ink containing chambers in one cartridge body are partitioned. The number of the ink containing chamber equipped in the cartridge body can be determined to be 3 or more. The more the number of the ink containing chamber increases, the more the positions in which the bubbles are trapped become multiple. Accordingly, an ability to block the downstream movement of the bubbles is improved. In particular, the more the ink containing chamber increases or the descending connection and the ascending connection are formed, the more reliably the bubbles can be prevented from reaching the detection position of the ink residual quantity sensor.

Next, when the ink I in the above-described ink cartridge 1 is exhausted or is lowered to a predetermined amount, a method of injecting ink into the used ink cartridge 1 according to an exemplary embodiment will be described with reference to FIGS. 13 and 14.

First, an ink re-filling apparatus used in the recovery method according to the exemplary embodiment will be described.

Figure 13:
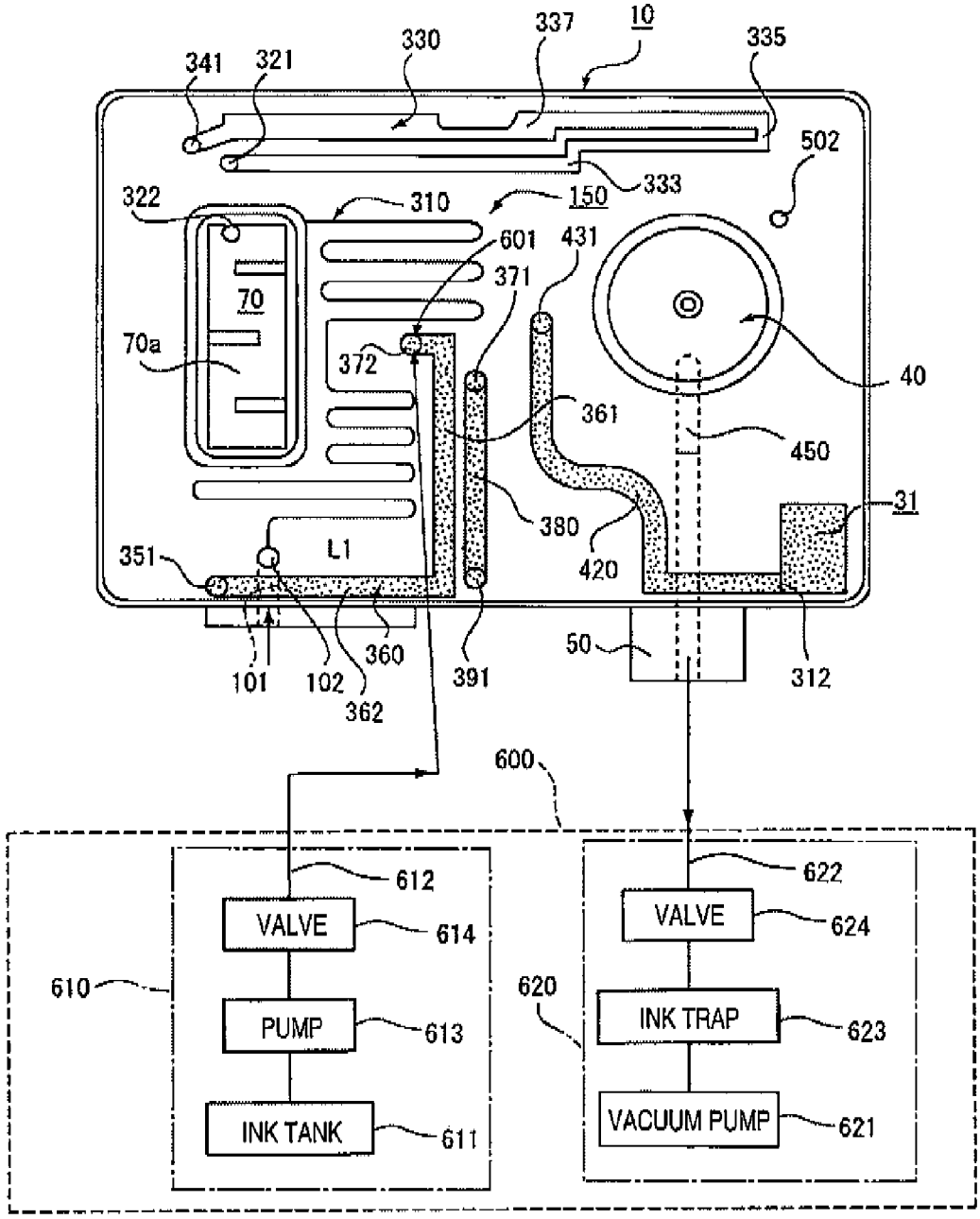
FIG. 13 is a block diagram illustrating a configuration of an ink re-filling apparatus by which a method of re-filling a liquid into an ink container according to the exemplary embodiment of the invention is performed.
Figure 14:
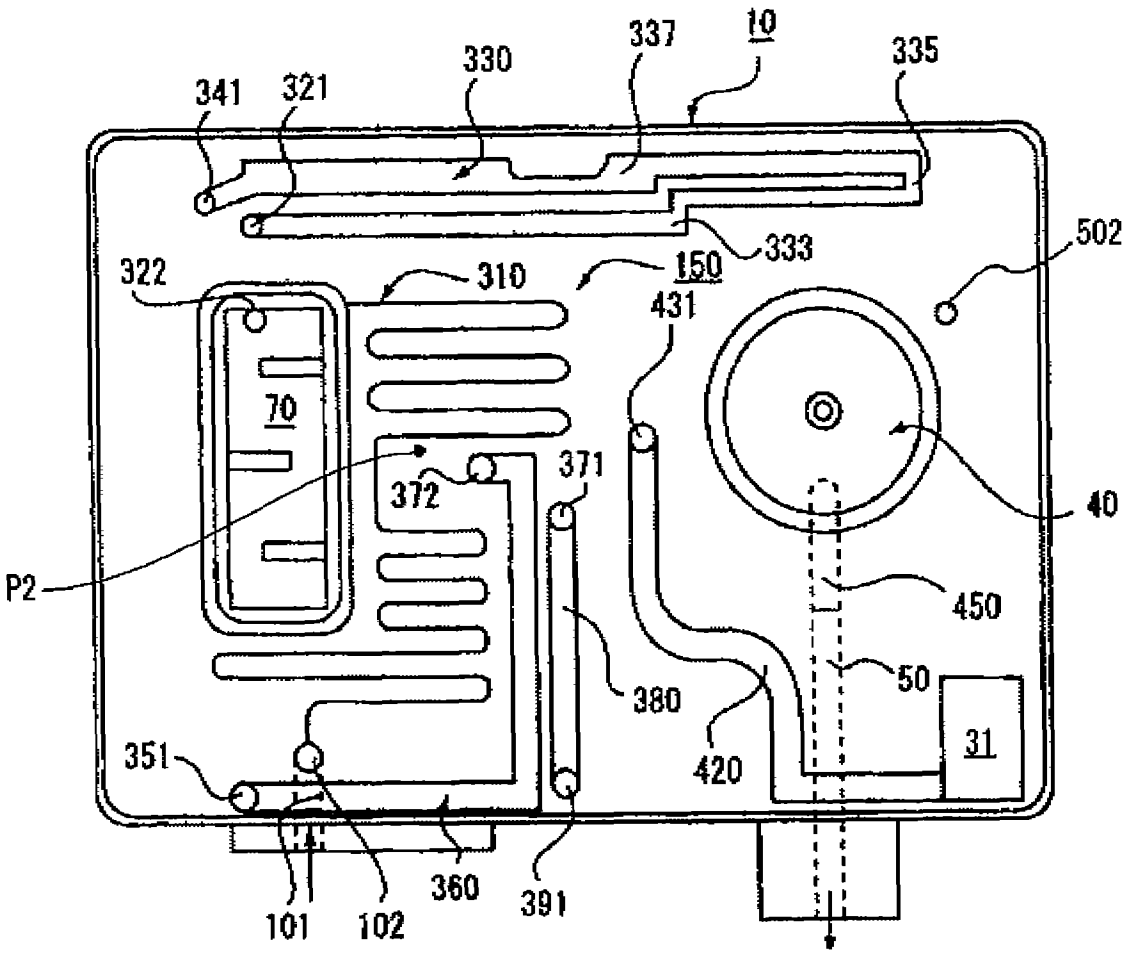
FIG. 14 is an explanatory view illustrating positions in which ink can be injected by the liquid injecting method according to the invention in the configuration of the ink cartridge shown in FIG. 10(*b*).

As shown in FIG. 13, an ink re-filling apparatus 600 includes an ink injecting mechanism 610 connected to an injection port 601, which is opened by a punching process in the cartridge body 10, and a vacuum sucking mechanism 620 connected to the ink supply hole 50 of the cartridge body 10.

The ink injecting mechanism 610 includes an ink tank 611 for storing the re-filled ink, a pump 613 for sending the ink stored in the ink tank 611 to a flow passage 612 connected to the injection port 601, and a valve 614 for opening/closing the flow passage 612 between the pump 613 and the injection port 601.

The vacuum sucking mechanism 620 includes a vacuum pump 621 for generating a negative pressure required for the vacuum sucking; a liquid guide passage 622 for allowing the negative pressure generated by the vacuum pump 621 to apply to the ink supply hole 50; an ink trap 623 for being provided in the liquid guide passage 622, catching/collecting the ink, which flows from the cartridge body 10 to the liquid guide passage 622 by means of the vacuum sucking, and protecting the vacuum pump 621 against ink mist or the like; and a valve 624 for opening/closing the liquid guide passage 622 between the ink trap 623 and the ink supply hole 50.

In the exemplary embodiment, in consideration of a configuration or a function of the ink cartridge 1, a position in which the injection port 601 communicating with the upper ink containing chamber 370 is formed in air communicating passage 150 is determined in the vicinity of a position opposite to the through-hole 372 which is positioned in a downstream end of the liquid guide passage 360 constituting a part of the air communicating passage 150.

The injection port 601 opposite the through-hole 372 is opened through the outer surface film 60 covering the rear surface of the cartridge body 10 so as to conform with the through-hole 372. In the front end portion of the flow passage 612 inserted into the injection port 601, for example, a sealing member or the like for air-tightly allowing the flow passage 612 to connect to the through-hole 372 is provided by tightly pressing against the through-hole 372 and attaching to the wall surface of the circumference of the through-hole 372.

The injection port 601 on the cartridge body 10 formed in the air communicating passage 150 is formed so as to communicate with the uppermost upper ink containing chamber 370 and the position of the injection port 601 is not limited to the position opposite the through-hole 372. For example, in a case where the injection port 601 is formed on the rear surface of the cartridge body 10, as shown in FIG. 14, a proper position P2 which interferes with the meandering passage 310 provided on the rear surface or the ink guide passage 380 may be set as a position in which the injection port 601 is provided.

According to the exemplary embodiment, the used ink cartridge 1 is recovered to a reusable ink cartridge (reusable liquid container) by, first, an injection port-forming step of opening the injection port 601 to the air communicating passage 150 so as to communicate with the upper ink containing chamber 370, a vacuum sucking step of sucking and removing the residual ink and residual air remaining in the inside through the ink supply hole 50 by the vacuum sucking mechanism 620, a liquid re-filling step of injecting a predetermined amount of ink through the injection port 601 by the ink injecting mechanism 610, and a sealing step of sealing the injection port 601 after the liquid re-filling step.

Specifically, the sealing step is a step by which the injection port 601 is air-tightly closed by attaching or welding a sealing film or a tape, by a plug, or the like.

In the above-described ink recovery method of the ink cartridge 1 according to the exemplary embodiment, a step of re-filling the ink I into the ink cartridge 1 is performed by the step of opening the injection port 601 to the air communicating passage 150 for re-filling the ink I so as to communicate with the uppermost upper ink containing chamber 370, re-filling the ink I, sealing the injection port 601, which are all the simple steps. As a result, a processing cost is low in price and it is not difficult to re-fill an ink cartridge.

In the exemplary embodiment, the vacuum sucking step of sucking and removing the residual ink and residual air remaining in the inside from the ink supply hole 50 is provided. Accordingly, when the liquid re-filling step of re-filling the predetermined amount of the ink I through the injection port 601 is performed, the ink guide passages 380, 420, and 440 or the ink containing chambers of the cartridge body 10 are controlled under the depressurization environment, and thus all the ink guide passages including the ink supply hole 50 as well as the ink containing chambers 370, 390, and 430 can effectively refill with the re-filled ink I.

Bubbles that are mixed when the ink I is re-filled can be extracted through the ink supply hole 50 to the outside by means of the vacuum sucking, or inflow bubbles can be dissolved/disappeared in the liquid under the depressurization environment in the container formed by means of the vacuum sucking.

Accordingly, the bubble B mixed at the time of re-filling the ink I does not float in the ink containing chambers or the ink guide passages or is not attached to the wall surfaces of the flow passages. For example, the problem that the ink residual quantity sensor does not normally operate since the bubble B remains in the vicinity of the ink residual quantity sensor can be solved.

Since the injection port 601 is provided in the air communicating passage that communicates with the uppermost upper ink containing chamber 370, the ink can be injected into all the plurality of ink containing chambers equipped in the cartridge body 10 and into the liquid guide passages communicating with mutual ink containing chambers.

Accordingly, in the recovered ink cartridge 1 into which the ink is injected, the upward and downward winding flow passage is recovered in the ink guide passage 380 that serves as an descending liquid guide passage by which the ink containing chambers are mutually connected and in the ink guide passage 420 that serves as an ascending liquid guide passage by which the ink containing chambers are mutually connected. When the bubble B occurs in the ink containing chamber 370 on the upstream side, the ink I remaining in the descending liquid guide passage serves as the barrier wall for blocking the downstream movement of the bubbles. For this reason, it is difficult for the bubble B entering into the ink guide passage 380 to flow to the downstream side.

In addition to the upward and downward winding flow passage for allowing the ink containing chambers to be mutually connected, the upper spaces of the ink containing chambers 390 and 430 on the downstream side each serves as a space for trapping the inflow bubbles. Accordingly, the upper spaces prevent the bubble B from moving to the downstream side.

That is, the bubble trapping function of the liquid guide passages 380 and 420 for allowing the ink containing chambers to be mutually connected or the bubble trapping function of the ink containing chambers 390 and 430 on the downstream side is recovered like a new manufactured ink cartridge 1.

Accordingly, like the new manufactured ink cartridge 1, the bubble B entering from the ink containing chambers to the ink guide passages can be prevented from reaching the detection position of the ink residual quantity sensor 31. As a result, the problem that an amount of disposed liquid increases due to an erroneous detection of the ink residual quantity sensor 31 caused by the bubble inflow can be solved.

That is, in the method of recovering the ink cartridge 1 according to the exemplary embodiment, when the ink is injected into the used ink cartridge 1, the step of the ink cartridge 1 can be small, and moreover the ink can be injected without damaging the original function of the ink cartridge 1. As a result, the recovered ink cartridge 1 can be manufactured in a low price.

When the ink cartridge recovered by such a recovery method is provided, the expected life span of the liquid container of the ink cartridge becomes longer. Accordingly, the resources can be saved and the environmental pollution can be prevented. Further, since a cost required to recover the ink cartridge is inexpensive, and the ink cartridge is provided at a low price, a running cost for the ink jet printing apparatus can be reduced.

Although the position of the injection port 601 is in the air communicating passage 601 that communicates with the uppermost upper ink containing chamber 370 in the above exemplary embodiment, it is not limited to the position. For example, an injection port may be formed on the outer surface film 60, the film 80 or the cartridge body 10 so as to directly communicate with the uppermost upper ink containing chamber 370 that is positioned on the most upstream side.

Specifically, the injection port can be formed by boring a hole in the outer surface film 60 covering the cartridge body 10 so as to directly communicate with the uppermost upper ink containing chamber 70. In addition, the cover member 20 is removed and thus the film 80 is exposed, and then the injection port can be formed by boring a hole in the film 80. Further, the injection hole can be formed by boring a hole in the cartridge body 10 welded with the film 60.

Even when the injection hole is formed so as to directly communicate with the uppermost upper ink containing chamber 370, as described above, a step of re-filling the ink I into the ink cartridge 1 is performed by the step of opening the injection port for re-filling the ink I, re-filling the ink I, sealing the injection port 601, which are all the simple steps. As a result, a processing cost is low in price and it is not difficult to re-fill an ink cartridge.

Since the injection port 601 is provided in the uppermost upper ink containing chamber, the ink can be injected into all the plurality of ink containing chambers equipped in the cartridge body 10 and into the liquid guide passages communicating with mutual ink containing chambers.

Accordingly, in the recovered ink cartridge 1 into which the ink is injected, the upward and downward winding flow passage is recovered in the ink guide passage 380 that serves as an descending liquid guide passage by which the ink containing chambers are mutually connected and in the ink guide passage 420 that serves as an ascending liquid guide passage by which the ink containing chambers are mutually connected. When the bubble B occurs in the ink containing chamber 370 on the upstream side, the ink I remaining in the descending liquid guide passage serves as the barrier wall for blocking the downstream movement of the bubbles. For this reason, it is difficult for the bubble B entering into the ink guide passage 380 to flow to the downstream side.

In addition to the upward and downward winding flow passage for allowing the ink containing chambers to be mutually connected, the upper spaces of the ink containing chambers 390 and 430 on the downstream side each serves as a space for trapping the inflow bubbles. Accordingly, the upper spaces prevent the bubble B from moving to the downstream side.

That is, the bubble trapping function of the liquid guide passages 380 and 420 for allowing the ink containing chambers to be mutually connected or the bubble trapping function of the ink containing chambers 390 and 430 on the downstream side is recovered like a new manufactured ink cartridge 1.

Accordingly, like the new manufactured ink cartridge 1, the bubble B entering from the ink containing chambers to the ink guide passages can be prevented from reaching the detection position of the ink residual quantity sensor 31. As a result, the problem that an amount of disposed liquid increases due to an erroneous detection of the ink residual quantity sensor 31 caused by the bubble inflow can be solved.

In the ink cartridge 1 according to the exemplary embodiment, the ink guide passage 420 by which the pair of the ink containing chambers are mutually connected so as to form the ascending connection is connected to the lower ink containing chamber 390 and the buffer chamber 430 through the upstream ink end sensor connecting passage 400 and the downstream ink end sensor connecting passage 410. The lower ink containing chamber 390 and the buffer chamber 430 are not connected by the ink guide passage 420. The liquid container according to the invention is not limited to the above-described configuration. A pair of the liquid containing chambers can be mutually connected so as to form the descending connection and the ascending connection in a series shape where they are alternated.

In addition, in the ink cartridge 1 according to the exemplary embodiment, after the ink guide passage 380 that serves as the descending connection, the ink guide passage 420 that serves as the ascending connection continues. Then, after the ink guide passage 440 that serves as the ascending liquid guide passage, the descending connection is realized in the outlet flow passage 450. The plural pairs of the combination of the descending connection and the ascending connection are provided.

When four liquid containing chambers are provided to the liquid container according to the invention, the liquid containing chambers are mutually connected in the way that at least one descending connection and ascending connection are alternated. The remaining liquid containing chambers can be connected so that the liquid flows are the descending connection and ascending connection, or other connections such as a horizontal connection by which the liquid flows in a horizontal direction and the like can be properly employed.

The liquid container manufactured according to the invention is not limited to the ink cartridge according to the exemplary embodiment. In addition, the liquid consuming device having a container-attached portion on which the liquid container according to the invention is mounted is not limited to the ink jet printing apparatus according to the exemplary embodiment.

The liquid consuming device corresponds to various apparatuses which include the container-attached portion which the liquid container is attached to and detached from, and which the liquid contained in the liquid container are supplied to. Specific examples of the liquid consuming device include an apparatus having a color material ejecting head used for manufacturing a color filter such as a liquid crystal display, an apparatus having an electrode material (conductive paste) ejecting head used for forming an electrode such as an organic EL display, and a field emission display (FED), an apparatus having a bioorganic matter ejecting head used for manufacturing a biochip, an apparatus having a sample ejecting head used for a precision pipette, and the like.

This application claims priority from Japanese Patent Application Nos. 2006-220755 filed on Aug. 11, 2006 and 2006-220762 filed on Aug. 12, 2006, the entire disclosure of which are expressly incorporated by reference herein.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. A method of manufacturing a liquid container detachably mounted on a liquid consuming device, the liquid container comprising:

a liquid containing chamber in which the liquid can be contained;

a liquid supply hole connectable to the liquid consuming device;

a liquid guide passage for guiding the liquid contained in the liquid containing chamber to the liquid supply hole; and an air introducing hole for introducing an air into the liquid containing chamber through an air communicating passage, wherein the liquid containing chamber includes at least three liquid containing chambers, and wherein the liquid containing chambers are mutually connected so as to have a descending connection where a pair of the liquid containing chambers are mutually connected so that a liquid flow in the liquid guide passage is a descending flow from above to below and an ascending connection where a pair of the liquid containing chambers are mutually connected so that the liquid flow in the liquid guide passage is an ascending flow from below to above, the method comprising:

forming an injection port, which communicates with the liquid containing chamber and is different from the air introducing hole, in the air communicating passage;

injecting a predetermined amount of liquid through the injection port; and sealing the injection port after injecting the liquid.

2. The method according to claim 1, wherein at least a part of the air communicating passage is formed by a film member, and the injection port is formed on the film member.

3. A method of manufacturing a liquid container detachably mounted on a liquid consuming device, the liquid container comprising:

a liquid containing chamber in which the liquid can be contained and a part of which is defined by a film member;

a liquid supply hole connectable to the liquid consuming device;

a liquid guide passage communicating the liquid containing chamber and the liquid supply hole with each other; and an air introducing hole for introducing an air into the liquid containing chamber through an air communicating passage, wherein the liquid containing chamber includes at least three liquid containing chambers, and wherein the liquid containing chambers are mutually connected so as to have a descending connection where a pair of the liquid containing chambers are mutually connected so that a liquid flow in the liquid guide passage is a descending flow from above to below and an ascending connection where a pair of the liquid containing chambers are mutually connected so that the liquid flow in the liquid guide passage is an ascending flow from below to above, the method comprising:

providing the liquid container;

forming an injection port, which is different from the air introducing hole, on the film member, a position of the injection port corresponding to the liquid containing chamber positioned on the most upstream side;

injecting a predetermined amount of liquid through the injection port; and sealing the injection port after injecting the liquid.

4. The method according to claim 3, wherein the air communicating passage is provided with an air chamber for preventing the liquid from leaking from the liquid containing chamber.

5. The method according to claim 3, wherein at least a part of the air communicating passage passes through an uppermost portion in a gravity direction of the liquid container.

6. The method according to claim 3, wherein the air communicating passage is provided with a gas-liquid separating filter for allowing a gas to pass therethrough and preventing a liquid from passing therethrough.

7. The method according to claim 3, further comprising: packing the liquid container in a depressurized pack and sealing the depressurized pack so that an inner pressure of the depressurized pack is below an air pressure.

8. The method according to claim 3, wherein at least a part of the liquid containing chamber positioned on the most upstream side is formed by a film member, and the injection port is formed on the film member.

9. The method according to claim 3, wherein the injection port is sealed by a film or a plug.

10. The method according to claim 3, wherein the liquid container further comprises a liquid detecting portion provided in the liquid guide passage and for outputting different signals between in a case where the liquid guide passage is filled with the liquid and in a case where the liquid guide passage includes air entered thereinto.

11. The method according to claim 3, wherein the liquid container includes a plurality of combinations of the descending connection and the ascending connection.

12. The method according to claim 3, wherein the liquid container further comprises a liquid detecting portion for outputting different signals between in a case where the liquid guide passage is filled with the liquid and in a case where the liquid guide passage includes air entered thereinto, and wherein the liquid detecting portion is provided on a more downstream side than the descending connection and the ascending connection in the liquid guide passage.

* * * * *